US009393814B2

(12) United States Patent
Aizawa

(10) Patent No.: US 9,393,814 B2
(45) Date of Patent: Jul. 19, 2016

(54) PRINTING UNIT AND THERMAL PRINTER

(71) Applicant: Seiko Instruments Inc., Chiba-shi, Chiba (JP)

(72) Inventor: Kazuyuki Aizawa, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 14/834,950

(22) Filed: Aug. 25, 2015

(65) Prior Publication Data

US 2016/0059588 A1 Mar. 3, 2016

(30) Foreign Application Priority Data

Aug. 27, 2014 (JP) ..... 2014-173027
Dec. 24, 2014 (JP) ..... 2014-260735

(51) Int. Cl.

| | |
|---|---|
| ***B41J 11/04*** | (2006.01) |
| ***B41J 2/32*** | (2006.01) |
| ***B41J 11/24*** | (2006.01) |
| ***B41J 29/02*** | (2006.01) |
| ***B41J 29/13*** | (2006.01) |

(52) U.S. Cl.

CPC .. *B41J 11/04* (2013.01); *B41J 2/32* (2013.01); *B41J 11/24* (2013.01); *B41J 29/02* (2013.01); *B41J 29/13* (2013.01)

(58) Field of Classification Search

CPC ..... B41J 11/04; B41J 11/24; B41J 29/02; B41J 29/13; B41J 2/32
USPC ..... 347/220
See application file for complete search history.

(56) References Cited

U.S. PATENT DOCUMENTS

2005/0069370 A1* 3/2005 Yamada ..... B41J 29/54 400/663
2007/0286659 A1* 12/2007 Yamada ..... B41J 2/325 400/58
2009/0153640 A1* 6/2009 Hirai ..... B41J 2/32 347/220
2009/0290010 A1* 11/2009 Nureki ..... B41J 2/32 347/220

FOREIGN PATENT DOCUMENTS

JP 2007-331112 A 12/2007

* cited by examiner

*Primary Examiner* — Stephen Meier
*Assistant Examiner* — Alexander D Shenderov
(74) *Attorney, Agent, or Firm* — Brinks Gilson & Lione

(57) ABSTRACT

A printing unit, comprising: a main body frame; a platen roller removably mounted on the main body frame; a lock mechanism supported on the main body frame so as to be pivotable between a locking position where the platen roller is held on the main body frame in a rotatable manner and an unlocking position where the platen roller is detachable from the main body frame; a thermal head held in press contact with an outer peripheral surface of the platen roller; a pivot shaft provided to one of the main body frame and the lock mechanism and inserted through shaft holes formed in another of the main body frame and the lock mechanism, the pivot shaft being configured to pivot the lock mechanism relative to the main body frame about the pivot shaft; and biasing members configured to bias the lock mechanism toward the locking position and bring the pivot shaft and opening edges of the shaft holes into abutment against each other.

9 Claims, 20 Drawing Sheets

PRINTING UNIT AND THERMAL PRINTER

RELATED APPLICATIONS

This application claims priority under 35 U.S.C. §119 to Japanese Patent Applications Nos. 2014-173027 filed on Aug. 27, 2014 and 2014-260735 filed on Dec. 24, 2014, the entire content of which are hereby incorporated by reference.

BACKGROUND OF THE INVENTION

1. Field of the Invention

The present invention relates to a printing unit and a thermal printer.

2. Description of the Related Art

Hitherto, thermal printers are configured to perform printing by heating a printing surface of a recording sheet with heating elements of a thermal head to develop a color on the printing surface while feeding the recording sheet through rotation of a platen roller under a state in which the recording sheet is nipped between the platen roller and the thermal head. In those thermal printers, the platen roller is removable to facilitate work of replacing the recording sheet or the like.

This type of thermal printer (printing unit) includes a main body frame, a thermal head, a platen roller, platen bearings mounted on a roller shaft protruding from both ends of the platen roller in a coaxial state, bearing insertion grooves formed in the main body frame so that the platen bearings are inserted in a removable state, a lock lever (lock mechanism) movable from a locking position where the platen bearings are locked so as not to detach from the bearing insertion grooves to an unlocking position where the platen bearings are detachable from the bearing insertion grooves, and a lever biasing member (biasing member) configured to bias the lock lever constantly toward the locking position. The platen bearings are pressed against inner peripheral end surfaces of the bearing insertion grooves by the lock lever located at the locking position, to thereby determine the positions of the platen bearings with respect to the main body frame. In this manner, the removable platen roller is positioned with respect to the main body frame.

In the above-mentioned printing unit, however, an external force caused by drop impact or the like may be applied to the main body frame or the lock arm to distort the respective components, resulting in decrease in holding force of the lock arm for the platen roller. Thus, there is a risk of such trouble that the platen roller may drop off from the main body frame. This type of printing unit is generally mounted in a housing having an openable and closable cover, but the strength of the housing is not set extremely high in consideration of weight and cost. Thus, when the thus housing drop may occur, an inertial force and a force caused by distortion or twist are generated in the housing due to the drop impact, and those forces are applied to the main body frame or the lock arm so that the above-mentioned trouble may occur. Further, when the platen roller drops off in this printer housing, the cover is opened so that the device may be damaged or the roll sheet may drop off, resulting in inconvenience to the user of the printer.

In this type of printing unit, a fit tolerance is set between a pivot shaft of the lock mechanism and a shaft hole of the main body frame through which the pivot shaft is inserted. Therefore, when an external force is applied to the printing unit, there is a risk in that the pivot shaft of the lock mechanism may be moved within a range of the fit tolerance, namely the pivot shaft of the lock mechanism may be rattled. When the pivot shaft of the lock mechanism is moved from a desired position, the holding force to be applied from the lock mechanism to the platen roller and the direction of application of the holding force may become unstable, thereby causing a risk of misalignment of the platen roller from the thermal head or the like. As a result, printing failure such as printing blurs and periodic unevenness, namely printing unevenness to be caused by a change in contact state between the heating elements and the recording sheet along with periodic vibrations may occur.

In view of the above-mentioned matters, a printing unit and a thermal printer capable of stabilizing the position of the platen roller with respect to the thermal head to secure print quality are demanded in this technical field.

SUMMARY OF THE INVENTION

According to one embodiment of the present invention, there is provided a printing unit, comprising: a main body frame; a thermal head mounted on the main body frame; a platen roller arranged so as to be opposed to the thermal head, which is configured to convey a recording sheet by rotating about an axis extending along a first direction under a state in which the recording sheet is nipped between the platen roller and the thermal head; roller insertion grooves formed in the main body frame, into which the platen roller is inserted in a state of being removable from the roller insertion grooves along a second direction orthogonal to the first direction; a lock arm supported so as to be pivotable about a pivot shaft extending along the first direction, which is configured to hold the platen roller inserted into the roller insertion grooves; a moving mechanism configured to move the pivot shaft; biasing members configured to bias the lock arm; and gripping portions provided to the lock arm, which are configured to extend from a region opposite to the thermal head across the platen roller toward the thermal head under a holding state in which the gripping portions hold the platen roller, in which a distal end portion of each of the gripping portions is formed so as to be located close to the thermal head side with respect to an imaginary plane including a center axis of the platen roller and an axis of the pivot shaft under the holding state, in which the moving mechanism is configured to move the pivot shaft between a locking position where a pivot of the lock arm is restricted under the holding state and a pivoting position where the lock arm is freely pivotable between the holding state and a releasing state in which the platen roller is removable from the roller insertion grooves, and in which the biasing members are configured to: bias the lock arm in a direction in which the pivot shaft is moved from the pivoting position to the locking position under the holding state; and bias the lock arm in a direction in which the lock arm is shifted from the releasing state to the holding state under a state in which the pivot shaft is located at the pivoting position.

According to the printing unit of the one embodiment of the present invention, the lock arm is biased by the biasing members so as to maintain the holding state, and is also biased so that the pivot shaft is located at the locking position under the holding state. Therefore, to release the platen roller, the lock arm configured to hold the platen roller requires two-stage operations, namely an operation of moving the pivot shaft to the pivoting position by the moving mechanism, and an operation of releasing the platen roller by pivoting about the pivot shaft. Thus, the platen roller is less liable to drop off from the roller insertion grooves even when an external force is applied to the lock arm. Further, the distal end portion of each of the gripping portions is formed so as to be located close to the thermal head side with respect to the imaginary plane including the center axis of the platen roller and the axis of the pivot shaft under the holding state, thereby being capable of suppressing the drop of the platen roller more securely. Thus, it is possible to attain a printing unit capable of stably holding the platen roller.

In the above-mentioned printing unit, the moving mechanism includes: elongate holes formed in the lock arm; and a shaft portion fixed to the main body frame and fitted to the elongate holes.

According to the printing unit of the one embodiment of the present invention, the shaft portion is relatively moved along a longitudinal direction of each of the elongate holes, thereby being capable of shifting between the pivoting position and the locking position. Thus, it is possible to easily form the moving mechanism configured to move the position of the pivot shaft with respect to the lock arm.

In the above-mentioned printing unit, a part of the each of the gripping portions to be brought into contact with the platen roller is formed into an arc shape conforming to an outer peripheral surface of the platen roller when viewed in the first direction.

According to the printing unit of the one embodiment of the present invention, the gripping portions hold the platen roller while being brought into contact with a wide region on the outer peripheral surface of the platen roller, thereby being capable of holding the platen roller more stably. Further, the platen roller is held by the arc-shaped part of each of the gripping portions so that the rotational locus of the distal end portion of each of the gripping portions interferes with the platen roller under a state in which the pivot shaft is located at the locking position, thereby being capable of easily forming the structure for restricting the pivot of the lock arm.

According to one embodiment of the present invention, there is provided a printing unit, comprising: a main body frame; a platen roller removably mounted on the main body frame; a lock mechanism supported on the main body frame so as to be pivotable between a locking position where the platen roller is held on the main body frame in a rotatable manner and an unlocking position where the platen roller is detachable from the main body frame; a thermal head held in press contact with an outer peripheral surface of the platen roller; a pivot shaft provided to one of the main body frame and the lock mechanism and inserted through shaft holes formed in another of the main body frame and the lock mechanism, the pivot shaft being configured to pivot the lock mechanism relative to the main body frame about the pivot shaft; and biasing members configured to bias the lock mechanism toward the locking position and bring the pivot shaft and opening edges of the shaft holes into abutment against each other.

According to the printing unit of the one embodiment of the present invention, the biasing members bias the lock mechanism toward the locking position and bring the pivot shaft into abutment against predetermined positions on the opening edges of the shaft holes, thereby being capable of positioning the lock mechanism at a desired position with respect to the main body frame. Thus, even if an external force is applied to the printing unit, for example, the movement of the pivot shaft within a range of a fit tolerance between the pivot shaft and the shaft holes can be suppressed. Accordingly, the holding force to be applied from the lock mechanism to the platen roller and the direction of application of the holding force can be stabilized so that the position of the platen roller with respect to the thermal head is stabilized, thereby being capable of securing the print quality.

In the above-mentioned printing unit, the shaft holes are elongate holes, and the biasing members are configured to bring the pivot shaft into abutment against a part of each of the opening edges of the shaft holes, which is located on one end side in a longitudinal direction of each of the shaft holes.

According to the printing unit of the one embodiment of the present invention, the pivot shaft is brought into abutment against the part of each of the opening edges of the shaft holes, which is located on one end side in the longitudinal direction of each of the shaft holes, thereby being capable of holding the pivot shaft at a desired position in each of the shaft holes while restricting the movement of the pivot shaft in a transverse direction of each of the shaft holes. Therefore, the position of the pivot shaft in each of the shaft holes is stabilized, thereby suppressing rattling of the lock mechanism. Thus, the position of the platen roller with respect to the thermal head can further be stabilized.

Besides, the shaft holes are formed as the elongate holes, and hence, as compared to a case where the shaft holes are formed as, for example, perfect circles, the biasing direction of each of the biasing members can be stabilized. As a result, the position of the platen roller with respect to the thermal head can further be stabilized, and the unevenness between the products can be suppressed. Further, the shaft holes are formed as the elongate holes, and hence the dimensions of the shaft holes can be managed easily, thereby being capable of suppressing the unevenness of manufacture. In addition, the life of a mold for forming the shaft holes is prolonged, thereby being capable of reducing the manufacturing cost.

In the above-mentioned printing unit, an intersection angle between the longitudinal direction of the each of the shaft holes and a biasing direction of each of the biasing members is 45° or less.

According to the printing unit of the one embodiment of the present invention, the biasing direction of each of the biasing members intersects the longitudinal direction of each of the shaft holes at an angle of 45° or less, and hence a force component corresponding to a half or more of the biasing forces of the biasing members can be applied in the longitudinal direction of each of the shaft holes. Thus, the pivot shaft can be held at a predetermined position in each of the shaft holes by a stronger force. Accordingly, it is possible to suppress the rattling of the lock mechanism more securely, thereby being capable of further stabilizing the position of the platen roller.

In the above-mentioned printing unit, the biasing members are interposed between the main body frame and the lock mechanism.

According to the printing unit of the one embodiment of the present invention, the biasing members are mounted inside the printing unit, and hence the printing unit can be assembled into the housing under a state in which the biasing members are mounted. Thus, as compared to the structure in which the biasing members are interposed between the housing and the lock mechanism, the printing unit can easily be assembled into the housing, thereby being capable of reducing the manufacturing cost.

A thermal printer according to one embodiment of the present invention includes the above-mentioned printing unit.

The thermal printer according to the one embodiment of the present invention includes the above-mentioned printing unit. Thus, it is possible to attain a thermal printer capable of stabilizing the position of the platen roller with respect to the thermal head to secure the print quality.

As described above, according to the printing unit and the thermal printer of the one embodiment of the present invention, the lock arm is biased by the biasing members so as to maintain the holding state, and is also biased so that the pivot shaft is located at the locking position under the holding state. Therefore, to release the platen roller, the lock arm configured to hold the platen roller requires the two-stage operations, namely the operation of moving the pivot shaft to the pivoting position by the moving mechanism, and the operation of releasing the platen roller by pivoting about the pivot shaft. Thus, the platen roller is less liable to drop off from the roller insertion grooves even when an external force is applied to the lock arm. Further, the distal end portion of each of the gripping portions is formed so as to be located close to the thermal head side with respect to the imaginary plane including the center axis of the platen roller and the axis of the pivot shaft under the holding state, thereby being capable of suppressing the drop of the platen roller more securely. Thus, it is possible to attain the printing unit capable of stably holding the platen roller.

Further, according to the printing unit and the thermal printer of the one embodiment of the present invention, the biasing members bias the lock mechanism toward the locking position and bring the pivot shaft into abutment against the predetermined positions on the opening edges of the shaft holes, thereby being capable of positioning the lock mechanism at a desired position with respect to the main body frame. Thus, even if an external force is applied to the printing unit, for example, the movement of the pivot shaft within the range of the fit tolerance between the pivot shaft and the shaft holes can be suppressed. Accordingly, the holding force to be applied from the lock mechanism to the platen roller and the direction of application of the holding force can be stabilized so that the position of the platen roller with respect to the thermal head is stabilized, thereby being capable of securing the print quality.

DETAILED DESCRIPTION OF THE PREFERRED EMBODIMENTS

First Embodiment

Now, a first embodiment of the present invention is described with reference to the accompanying drawings.

Figure 1:
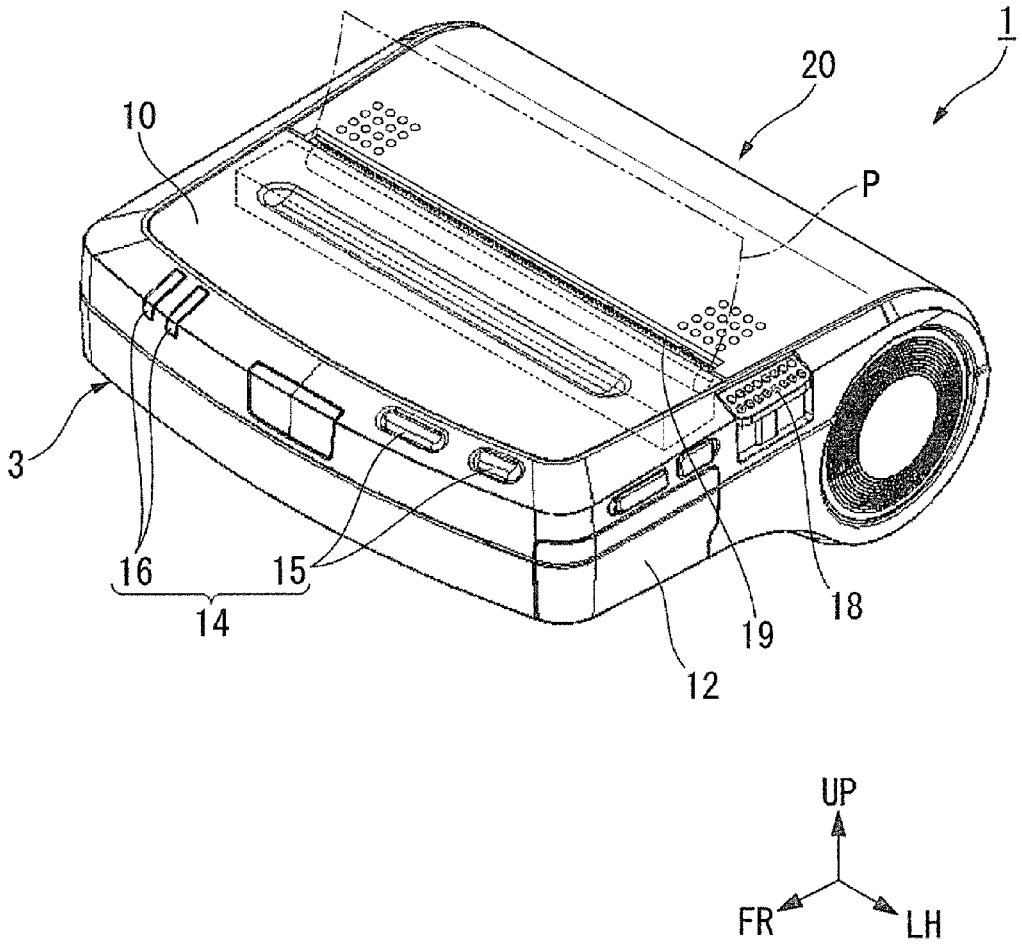
FIG. 1 is a perspective view of a thermal printer according to a first embodiment of the present invention.
Figure 2:
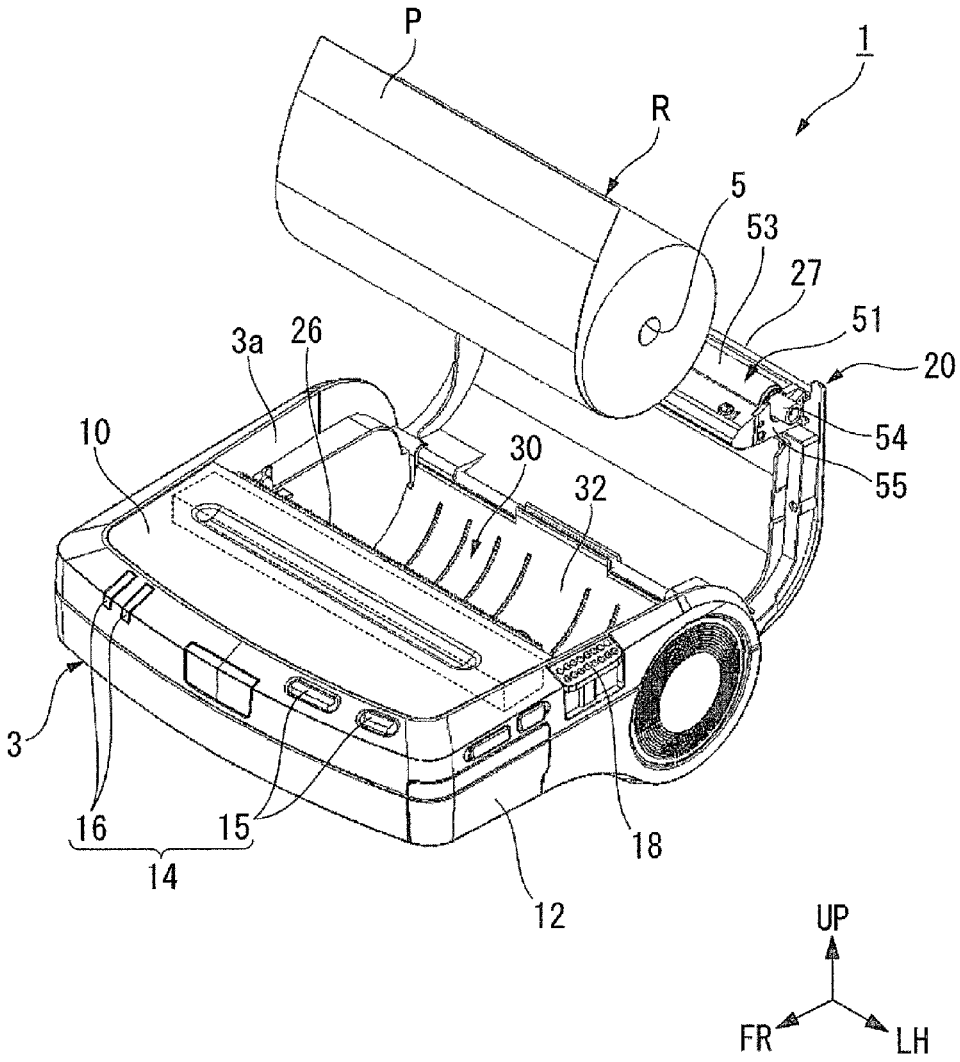
FIG. 2 is a perspective view of the thermal printer according to the first embodiment of the present invention, for illustrating a state in which a paper cover is located at an opened position.

FIG. 1 is a perspective view of a thermal printer at the time when a paper cover is located at a closed position. FIG. 2 is a perspective view of the thermal printer at the time when the paper cover is located at an opened position. The thermal printer is used in a state of being placed on a mounting surface. In the figures, the arrow UP is defined as an upper side, the arrow FR is defined as a front side, and the arrow LH is defined as a left side.

As illustrated in FIG. 1, a thermal printer 1 is capable of performing printing on a recording sheet P. The recording sheet P is a heat sensitive sheet that undergoes a color change when heat is applied thereto, and is used suitably for printing a variety of labels, receipts, and tickets. As illustrated in FIG. 2, the recording sheet P is set in the thermal printer 1 in a state of a roll sheet R obtained by rolling the recording sheet P so as to have a hollow hole 5, and printing is performed on a part drawn from the roll sheet R.

The thermal printer 1 includes a casing 3 having an opening portion 3*a*, and a paper cover 20 supported on the casing 3 in a pivotable manner and configured to open and close the opening portion 3*a* of the casing 3. Further, the thermal printer 1 has a printing unit 30 mounted therein.

The casing 3 is made of plastics such as polycarbonate, or a metal material. A front part of the casing 3 is formed into a substantially rectangular parallelepiped shape having an upper wall 10, whereas a rear part thereof is formed into a box shape opening upward. Ribs (not shown) or the like are formed on an inner surface of the casing 3 to enhance the mechanical strength of the casing 3. On the upper wall 10 of the casing 3, operation portions 14 configured to perform a variety of operations for the thermal printer 1 are arranged. As the operation portions 14, a variety of function switches 15 such as a power switch and a FEED switch are arranged, and a variety of indicator lamps 16 are arranged, such as a POWER indicator lamp provided adjacent to the function switches 15 and configured to indicate ON/OFF information of the power switch, and an ERROR indicator lamp configured to indicate an error and the like of the thermal printer 1. Further, an open button 18 for the paper cover 20 is provided between the upper wall 10 and a side wall 12 of the casing 3. Still further, a first cutting blade 26 configured to cut the recording sheet P is formed at a rear end edge of the upper wall 10 of the casing 3.

The paper cover 20 is made of plastics such as polycarbonate. The paper cover 20 is supported at its rear end on a main body frame 31 (see FIG. 3) of the printing unit 30 by a hinge shaft (not shown) in a pivotable manner. Further, the paper cover 20 is engageable at its front end with the main body frame 31 by a platen roller 51 described later, which is mounted on the front end. The paper cover 20 is disengaged from the casing 3 having the main body frame 31 mounted therein by depressing the open button 18 of the casing 3, and is openable and closable from the closed position (see FIG. 1) to the open position (see FIG. 2). Further, as illustrated in FIG. 1, when the paper cover 20 is located at the closed position, a clearance is secured between a front end edge of the paper cover 20 and the rear end edge of the upper wall 10 of the casing 3 along a width direction of the recording sheet P. The clearance forms a discharge port 19 through which the printed recording sheet P is discharged. Still further, a second cutting blade 27 (see FIG. 2) configured to cut the recording sheet P is formed at the front end edge of the paper cover 20. The recording sheet P conveyed through the discharge port 19 is cut by pulling down the recording sheet P in a state of being in contact with the first cutting blade 26 or the second cutting blade 27 described above.

Figure 3:
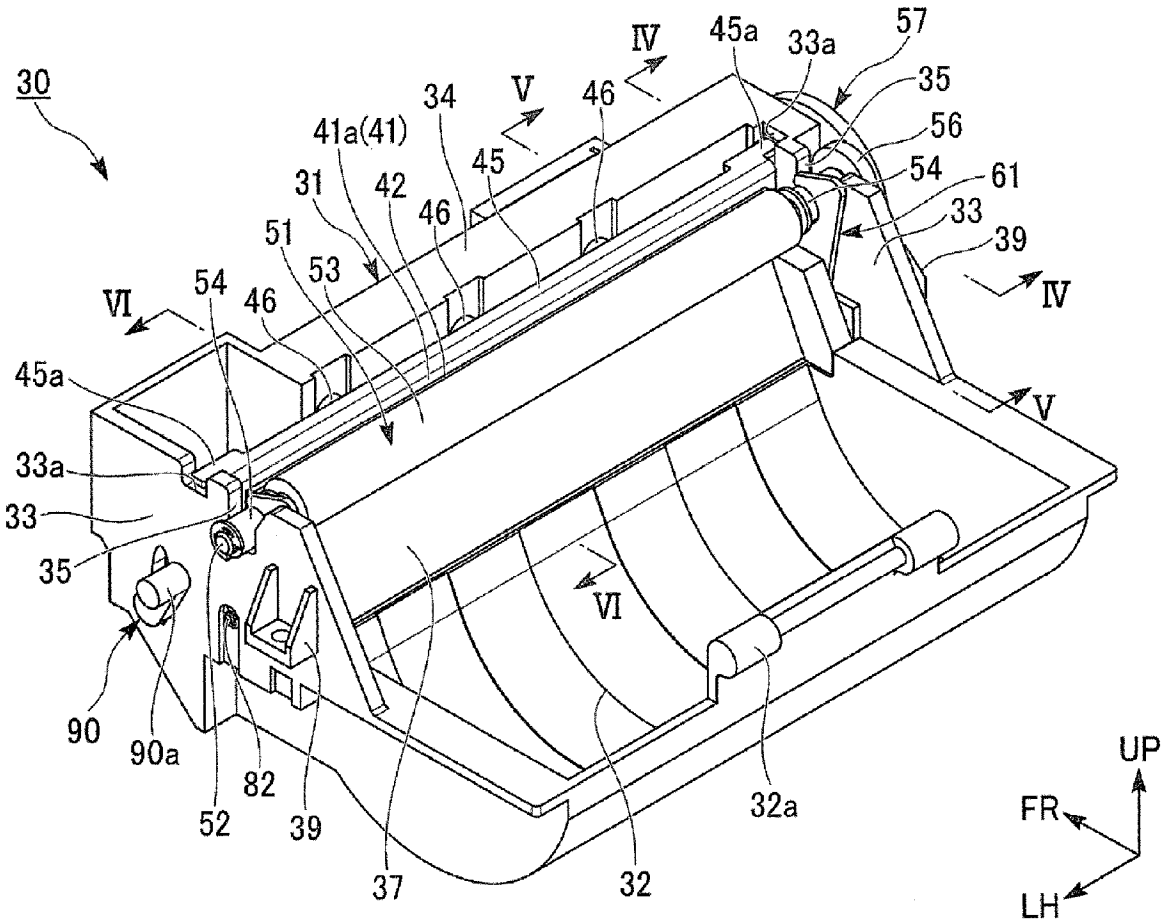
FIG. 3 is a perspective view of a printing unit according to the first embodiment of the present invention.

FIG. 3 is a perspective view of the printing unit. As illustrated in FIG. 3, the printing unit 30 includes the main body frame 31, a thermal head 41, the platen roller 51, and a lock arm 61.

The main body frame 31 includes a sheet receiving portion 32 formed at a bottom part thereof to extend in a lateral direction corresponding to a "first direction" in the claims, a pair of side wall portions 33 formed upright from both sides of the sheet receiving portion 32 in the lateral direction toward the upper side, and a front wall portion 34 formed upright from a front side of the sheet receiving portion 32 toward the upper side. The sheet receiving portion 32 is herein described as being included in the printing unit 30 (main body frame 31), but the sheet receiving portion 32 may be provided separately from the printing unit 30 as a matter of course. For example, the sheet receiving portion 32 may be formed integrally with a part of the inner surface of the casing 3. The sheet receiving portion 32 holds the roll sheet R. The sheet receiving portion 32 is a member having an arc shape in cross section, and a rear end of the sheet receiving portion 32 extends to the rear end side of the paper cover 20 (see FIG. 2), whereas a front end of the sheet receiving portion 32 extends to a lower side of the platen roller 51 described later. A hinge portion 32*a* configured to support the paper cover 20 in a pivotable manner is formed at a rear end edge of the sheet receiving portion 32. Further, a guide member 37 is arranged above the front end of the sheet receiving portion 32 so as to be smoothly connected to a curved surface of the sheet receiving portion 32. With the guide member 37, the recording sheet P is smoothly introduced toward the thermal head 41 described later.

Figure 4:
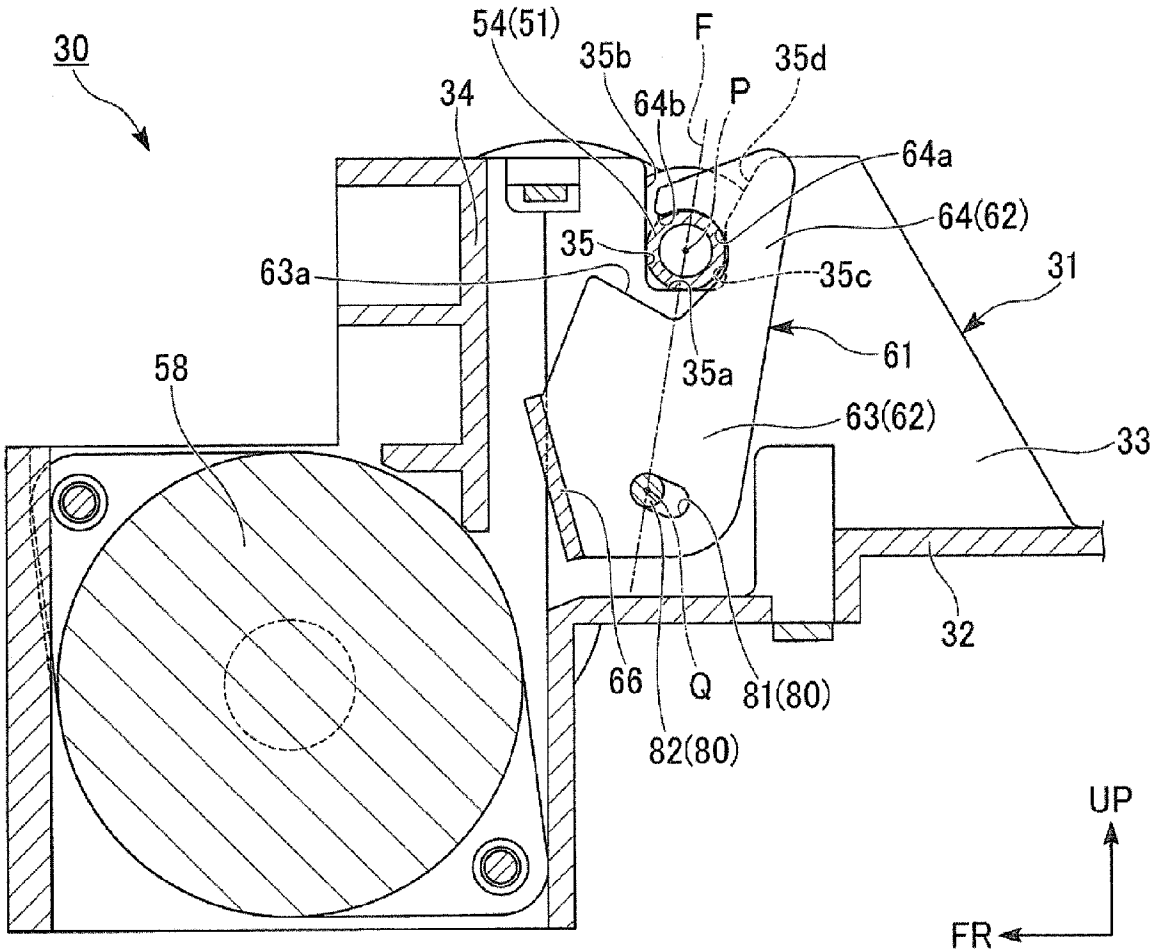
FIG. 4 is a sectional view taken along the line IV-IV of FIG. 3.

FIG. 4 is a sectional view taken along the line IV-IV of FIG. 3. Roller insertion grooves 35 cut downward are formed in upper end edges of the respective side wall portions 33. The platen roller 51 is inserted into the roller insertion grooves 35 in a state of being removable from the roller insertion grooves 35 along a vertical direction corresponding to a "second direction" in the claims. As illustrated in FIG. 4, when viewed in the lateral direction, each roller insertion groove 35 is defined by a groove bottom surface 35*a* extending in a fore-and-aft direction, a groove front surface 35*b* extending from a front end of the groove bottom surface 35*a* toward the upper side, a groove rear surface 35*c* extending from a rear end of the groove bottom surface 35*a* toward the upper side, and a groove inclined surface 35*d* extending from an upper end of the groove rear surface 35*c* obliquely toward an upper rear side.

The length of the groove bottom surface 35*a* in the fore-and-aft direction is slightly larger than the outer diameter of each bearing 54 of the platen roller 51. Each of the groove front surface 35*b* and the groove rear surface 35*c* is orthogonal to the groove bottom surface 35*a*. The length of the groove front surface 35*b* in the vertical direction is about twice as large as the outer diameter of the bearing 54. The length of the groove rear surface 35*c* in the vertical direction is slightly smaller than the outer diameter of the bearing 54. The groove inclined surface 35*d* is formed so as to compensate for a difference between the lengths of the groove front surface 35*b* and the groove rear surface 35*c* in the vertical direction. The roller insertion grooves 35 are formed at the same position when viewed in the lateral direction, and the platen roller 51 is inserted into the roller insertion grooves 35 in a state of extending along the lateral direction and being removable from the roller insertion grooves 35 along the vertical direction. Due to the groove inclined surface 35*d*, the opening width of each roller insertion groove 35 is increased as approaching the upper side. With this structure, the platen roller 51 is smoothly insertable into the roller insertion grooves 35.

As illustrated in FIG. 3, the thermal head 41 is configured to perform printing on the recording sheet P, and is formed into a rectangular shape when viewed in the fore-and-aft direction. The thermal head 41 is arranged on an inner side of the upper wall 10 of the casing 3 so as to be exposed into the opening portion 3*a*, and is arranged under a state in which a longitudinal direction of the thermal head 41 matches with the width direction of the recording sheet P. On a head surface 41*a* of the thermal head 41, a large number of heating elements 42 are arrayed in line and in parallel to the lateral direction. The head surface 41*a* is opposed to a printing surface of the recording sheet P, and the recording sheet P may be nipped between the head surface 41*a* and an outer peripheral surface of the platen roller 51. The heating elements 42 of the thermal head 41 are each controlled to generate heat based on a signal from a control unit (not shown). Through the control of heat generation of the heating elements 42, the thermal head 41 prints various kinds of letters and figures on the printing surface of the recording sheet P.

Figure 5:
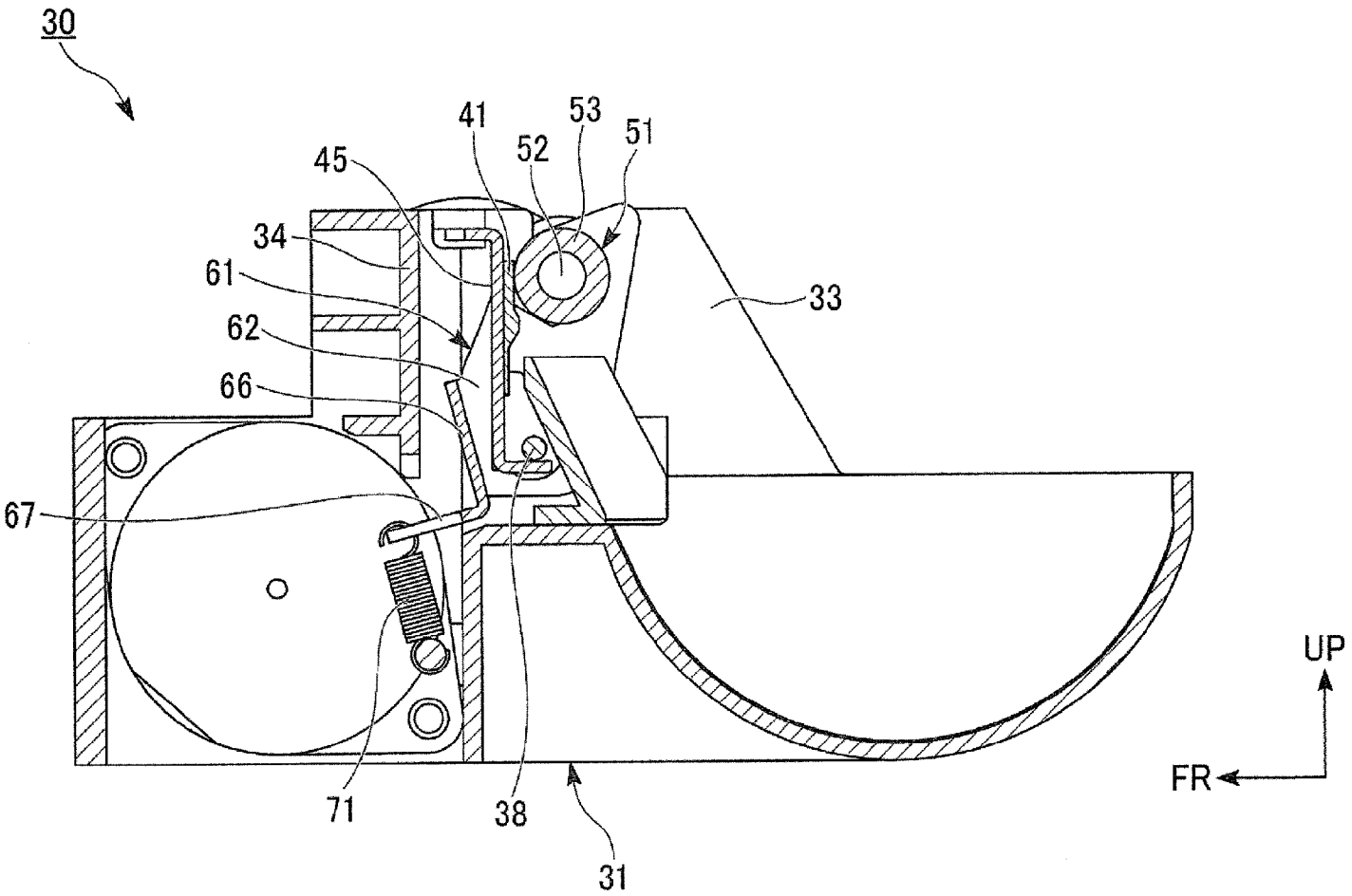
FIG. 5 is a sectional view taken along the line V-V of FIG. 3.
Figure 6:
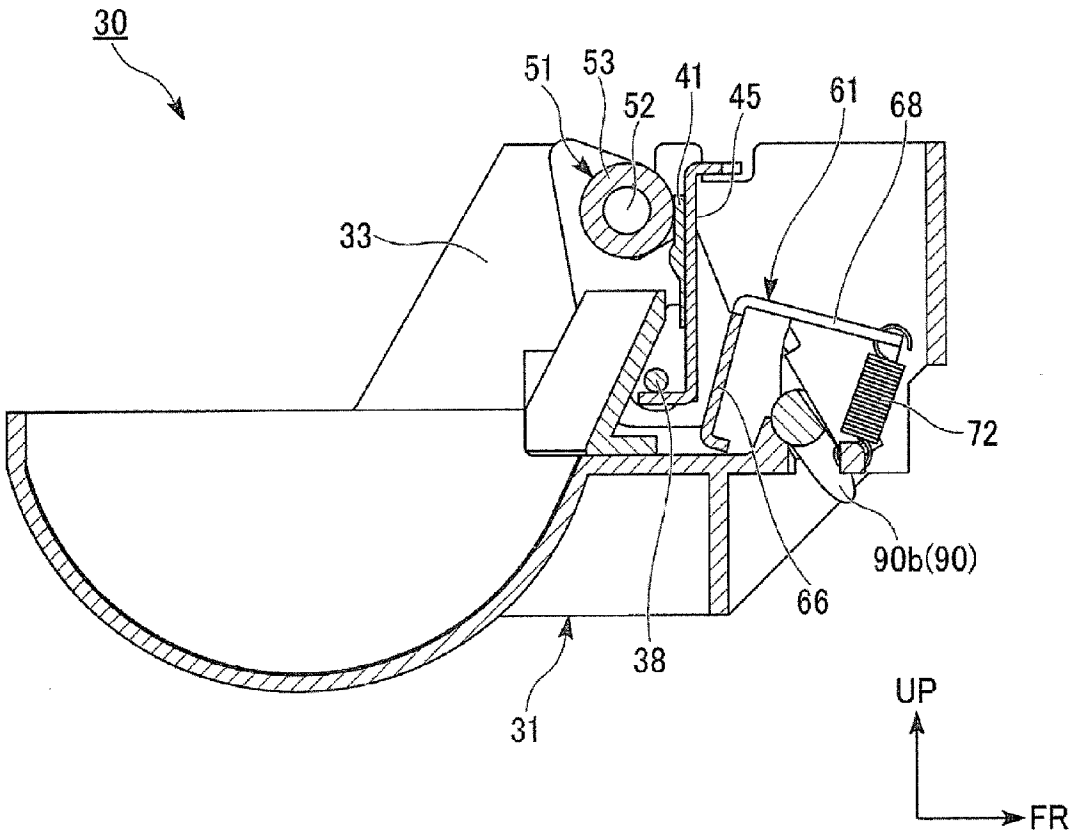
FIG. 6 is a sectional view taken along the line VI-VI of FIG. 3.

FIG. 5 is a sectional view taken along the line V-V of FIG. 3. FIG. 6 is a sectional view taken along the line VI-VI of FIG. 3. The thermal head 41 is bonded and fixed onto a head support member 45 supported on the main body frame 31. As illustrated in FIG. 5 and FIG. 6, the head support member 45 is a plate-like member having its longitudinal direction defined as the lateral direction. The head support member 45 is arranged between the pair of side wall portions 33, and the thermal head 41 is bonded and fixed onto a rear surface of the head support member 45. The head support member 45 is arranged behind the front wall portion 34 of the main body frame 31, and a lower end portion of the head support member 45 is supported on a first shaft 38 in a pivotable manner. The first shaft 38 is arranged so that an axial direction of a center axis of the first shaft 38 is defined along the lateral direction, and both axial end portions of the first shaft 38 are fixed to the pair of side wall portions 33, respectively. As illustrated in FIG. 3, a plurality of (in the first embodiment, three) elastic members 46 are interposed between the head support member 45 and the front wall portion 34 along the lateral direction. The elastic members 46 bias the head support member 45 and the front wall portion 34 in directions away from each other. That is, the elastic members 46 are configured to press the head support member 45 constantly rearward.

Stoppers 45*a* configured to regulate a pivot range of the head support member 45 are formed at upper end portions of the head support member 45. Each stopper 45*a* extends outward in a lateral direction of the head support member 45, and is formed so as to face an inside of a recessed portion 33*a* formed in an upper part of the side wall portion 33 of the main body frame 31. The stopper 45*a* is configured to move inside the recessed portion 33*a* along with the pivot of the head support member 45, and may be brought into contact with both end surfaces of the recessed portion 33*a*. Through the contact of the stopper 45*a* with the end surfaces of the recessed portion 33*a*, the pivot amount of the head support member 45 is regulated.

The platen roller 51 is arranged so as to be opposed to the thermal head 41, and is rotated about an axis extending along the lateral direction under a state in which the recording sheet P is nipped between the platen roller 51 and the thermal head 41, to thereby convey the recording sheet P. The platen roller 51 includes a roller shaft 52, a roller main body 53 mounted on the roller shaft 52, and a pair of the bearings 54 mounted at both ends of the roller shaft 52. The roller shaft 52 is formed slightly longer than the separation distance between the pair of side wall portions 33 of the main body frame 31. The roller main body 53 is made of, for example, rubber, and is arranged along an axial direction of the roller shaft 52 uniformly over the entire region excluding portions corresponding to both the ends of the roller shaft 52.

As illustrated in FIG. 2, the platen roller 51 is mounted in a freely pivotable manner at the front end edge of the paper cover 20 through intermediation of a platen frame 55, and is removable from the main body frame 31 along with the opening and closing operation of the paper cover 20. As illustrated in FIG. 3, under a state in which the paper cover 20 is located at the closed position (see FIG. 1), the pair of bearings 54 of the platen roller 51, which are mounted at both ends of the platen roller 51, are inserted into the roller insertion grooves 35 of the main body frame 31, respectively. Thus, the platen roller 51 is held so as to be rotatable about a center axis P (see FIG. 4) relative to the main body frame 31 and removable from the main body frame 31. The platen roller 51 is arranged so that the roller main body 53 is brought into contact with the thermal head 41 under the state in which the platen roller 51 is inserted into the roller insertion grooves 35 and the recording sheet P drawn out from the roll sheet R is nipped between the platen roller 51 and the thermal head 41.

Further, a driven gear 56 is fixed to one axial end of the platen roller 51, which is a right end in FIG. 3. The driven gear 56 meshes with a gear transmission mechanism 57 mounted on the main body frame 31 when the platen roller 51 is held on the pair of side wall portions 33. The gear transmission mechanism 57 is connected to driving means 58 such as a motor (see FIG. 4) to transmit a rotational driving force from the driving means 58 to the driven gear 56. Thus, the platen roller 51 is rotated in a state of being held on the pair of side wall portions 33, thereby being capable of conveying the recording sheet P.

Figure 7:
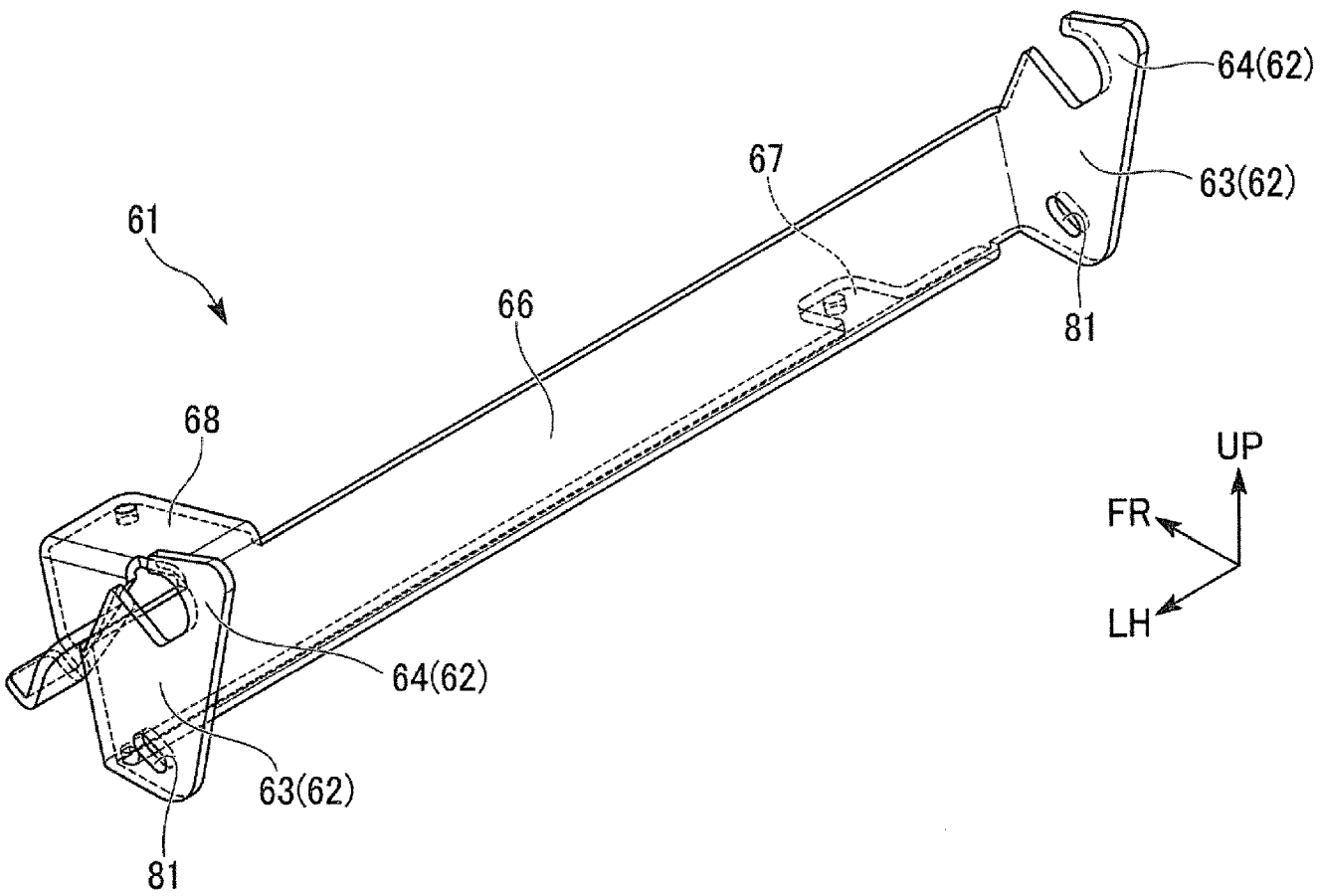
FIG. 7 is a perspective view of a lock arm according to the first embodiment of the present invention.

FIG. 7 is a perspective view of the lock arm. As illustrated in FIG. 4 and FIG. 7, the lock arm 61 is supported so as to be pivotable about a pivot axis (center axis Q) extending along the lateral direction, and is configured to hold the platen roller 51 inserted into the roller insertion grooves 35. The lock arm 61 includes a pair of side plate portions 62 extending along the pair of side wall portions 33 of the main body frame 31, respectively, and a rear plate portion 66 connecting the pair of side plate portions 62. The pair of side plate portions 62 are formed into the same shape, and hence only one of the side plate portions 62 is described below. Unless otherwise noted, the following description of the structure of the lock arm 61 is directed to a state in which the lock arm 61 holds the platen roller 51 inserted into the roller insertion grooves 35 as illustrated in FIG. 4 (hereinafter referred to as "holding state").

As illustrated in FIG. 4, the side plate portion 62 is a flat plate-like member including a base portion 63 arranged below the roller insertion groove 35 when viewed in the lateral direction, and a gripping portion 64 extending upward from an upper-end rear part of the base portion 63. The gripping portion 64 extends from a region opposite to the thermal head 41 (see FIG. 3) across the platen roller 51 toward the thermal head 41 through an upper side of the platen roller 51.

The base portion 63 has an elongate hole 81 formed in a lower part thereof. The elongate hole 81 is formed into an oblong shape having a major axis defined along the fore-and-aft direction, and a second shaft 82 corresponding to a "shaft portion" in the claims is fitted to the elongate hole 81. The second shaft 82 is arranged so that the center axis Q is defined along the lateral direction, and both axial end portions of the second shaft 82 are fixed to the pair of side wall portions 33, respectively. With the elongate hole 81 and the second shaft 82, the gripping portion 64 is pivoted in the fore-and-aft direction about the center axis Q of the second shaft 82 corresponding to a "pivot shaft" in the claims. Further, a moving mechanism 80 formed by the elongate hole 81 and the second shaft 82 is capable of moving the pivot center (center axis Q) of the lock arm 61 relative to the lock arm 61. That is, the moving mechanism 80 is capable of moving the second shaft 82 relatively between a front part of the elongate hole 81 (hereinafter referred to as "locking position") and a rear part of the elongate hole 81 (hereinafter referred to as "pivoting position").

The base portion 63 has an upper end surface 63*a* formed at an upper-end front part thereof to extend obliquely toward an upper front side. A front end surface 64*a* of the gripping portion 64 is connected to a rear end of the upper end surface 63*a*. The front end surface 64*a* extends from the rear end of the upper end surface 63*a* of the base portion 63 obliquely toward the upper rear side, and is then curved toward the front side. The curved part of the front end surface 64*a* is formed into an arc shape conforming to an outer peripheral surface of the bearing 54 of the platen roller 51 when viewed in the lateral direction, and has a curvature radius slightly larger than the radius of the bearing 54. The curved part of the front end surface 64*a* is brought into contact with the bearing 54 so that the lock arm 61 sandwiches the bearing 54 between the lock arm 61 and the roller insertion groove 35, to thereby hold the bearing 54.

Figure 8:
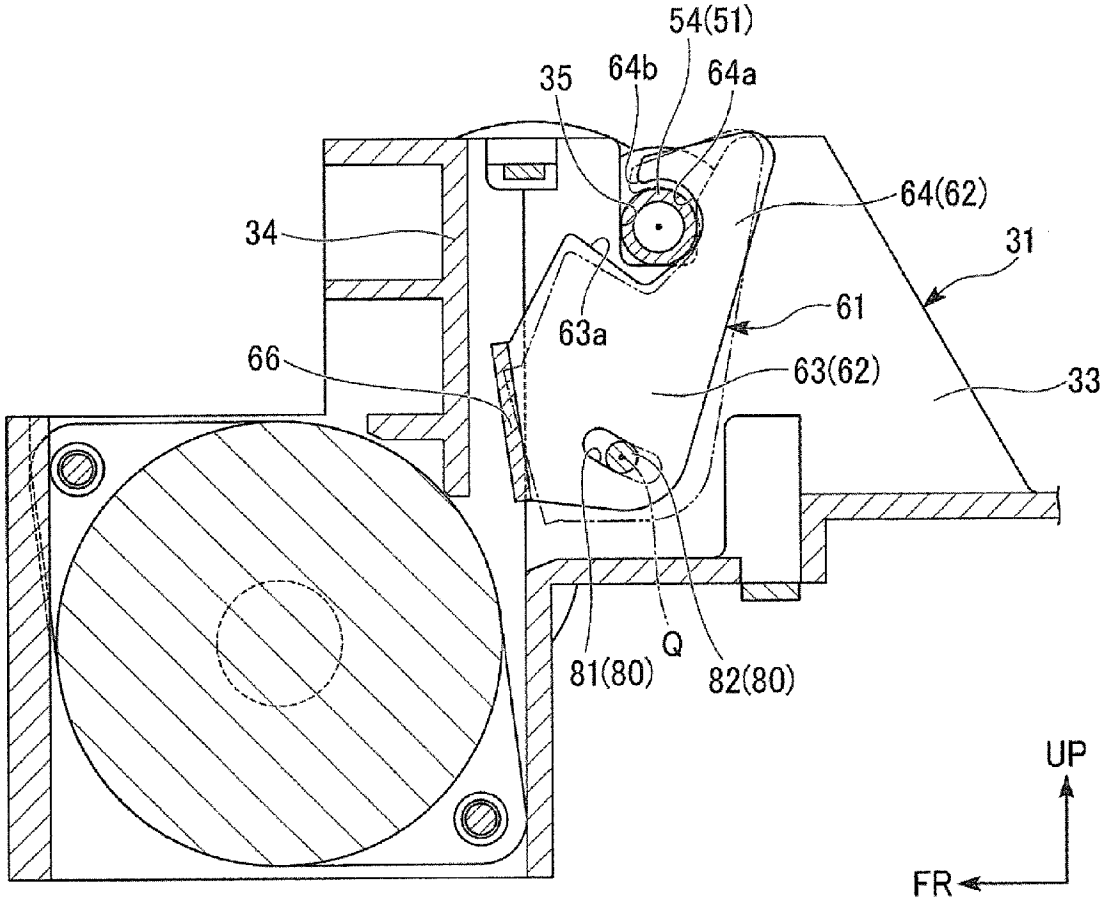
FIG. 8 is an explanatory view of an operation of the lock arm according to the first embodiment of the present invention, and is a sectional view of a part corresponding to the region taken along the line IV-IV of FIG. 3.

A distal end portion 64*b* of the gripping portion 64 (front end of the front end surface 64*a*) is formed so as to be located in a region close to the thermal head 41 side (front side) with respect to an imaginary plane F including the center axis P of the platen roller 51 and the center axis Q of the second shaft 82. The distal end portion 64*b* is formed so that the closest proximity distance between the distal end portion 64*b* and the upper end surface 63*a* is longer than the outer diameter of the bearing 54. Further, the distal end portion 64*b* is formed so that, under a state in which the second shaft 82 is located at the locking position in the elongate hole 81 as illustrated in FIG. 4, the distance between the distal end portion 64*b* and the center axis Q of the second shaft 82 is shorter than the longest distance between the center axis Q of the second shaft 82 and the outer peripheral surface of the bearing 54. Thus, in the state illustrated in FIG. 4, the distal end portion 64*b* is brought into contact with the bearing 54 so that the pivot of the side plate portion 62 about the center axis Q is restricted. Further, the distal end portion 64*b* is formed so that, under a state in which the second shaft 82 is located at the pivoting position in the elongate hole 81 as illustrated in FIG. 8, the distance between the distal end portion 64*b* and the center axis Q of the second shaft 82 is longer than the longest distance between the center axis Q of the second shaft 82 and the outer peripheral surface of the bearing 54. Thus, the side plate portion 62 is pivotable about the center axis Q while keeping the distal end portion 64*b* out of contact with the bearing 54 (see FIG. 8).

As illustrated in FIG. 7, the rear plate portion 66 is a flat plate-like member having its longitudinal direction defined as the lateral direction, and is arranged between the pair of side wall portions 33. The rear plate portion 66 is formed integrally with the pair of side plate portions 62 to connect front ends of the pair of side plate portions 62. The rear plate portion 66 includes a first coupling portion 67 formed at a lower right end portion thereof to protrude forward, and a second coupling portion 68 formed at an upper left end portion thereof to protrude forward. As illustrated in FIG. 5, one end portion of a first biasing member 71 such as a coil spring is connected to the first coupling portion 67. The other end portion of the first biasing member 71 is connected to the main body frame 31 at a position below the first coupling portion 67 to bias the first coupling portion 67 downward. As illustrated in FIG. 6, one end portion of a second biasing member 72 such as a coil spring is connected to the second coupling portion 68. The other end portion of the second biasing member 72 is connected to the main body frame 31 at a position below the second coupling portion 68 to bias the second coupling portion 68 downward.

As illustrated in FIG. 3, the above-mentioned printing unit 30 includes a lever 90. The lever 90 is mounted on the left side wall portion 33 in a freely pivotable manner. One end portion 90*a* of the lever 90 is arranged on an outer side of the side wall portion 33, whereas another end portion 90*b* of the lever 90 (see FIG. 6) located opposite to the one end portion 90*a* across a pivot axis of the lever 90 is arranged on an inner side of the side wall portion 33. As illustrated in FIG. 6, the other end portion 90*b* of the lever 90 is held in contact with a lower surface of the second coupling portion 68 of the lock arm 61. When the one end portion 90*a* is pushed down, the second coupling portion 68 of the lock arm 61 is pushed up by the other end portion 90*b*. The one end portion 90*a* of the lever 90 is arranged below the open button 18 arranged on the casing 3. The one end portion 90*a* of the lever 90 is pushed down by depressing the open button 18.

The printing unit 30 is fixed to the casing 3 through intermediation of a pair of fixing portions 39 formed in the vicinity of the respective roller insertion grooves 35 of the pair of side wall portions 33. As in this structure, the number of portions to be fixed to the casing 3 is reduced, thereby being capable of suppressing the twist of the main body frame 31 when an external force is applied to the casing 3 to twist the casing 3. Further, the fixing portions 39 are formed in the vicinity of the roller insertion grooves 35, thereby being capable of suppressing the twist of the platen roller 51 when the main body frame 31 is twisted through intermediation of the fixing portions 39.

Figure 9:
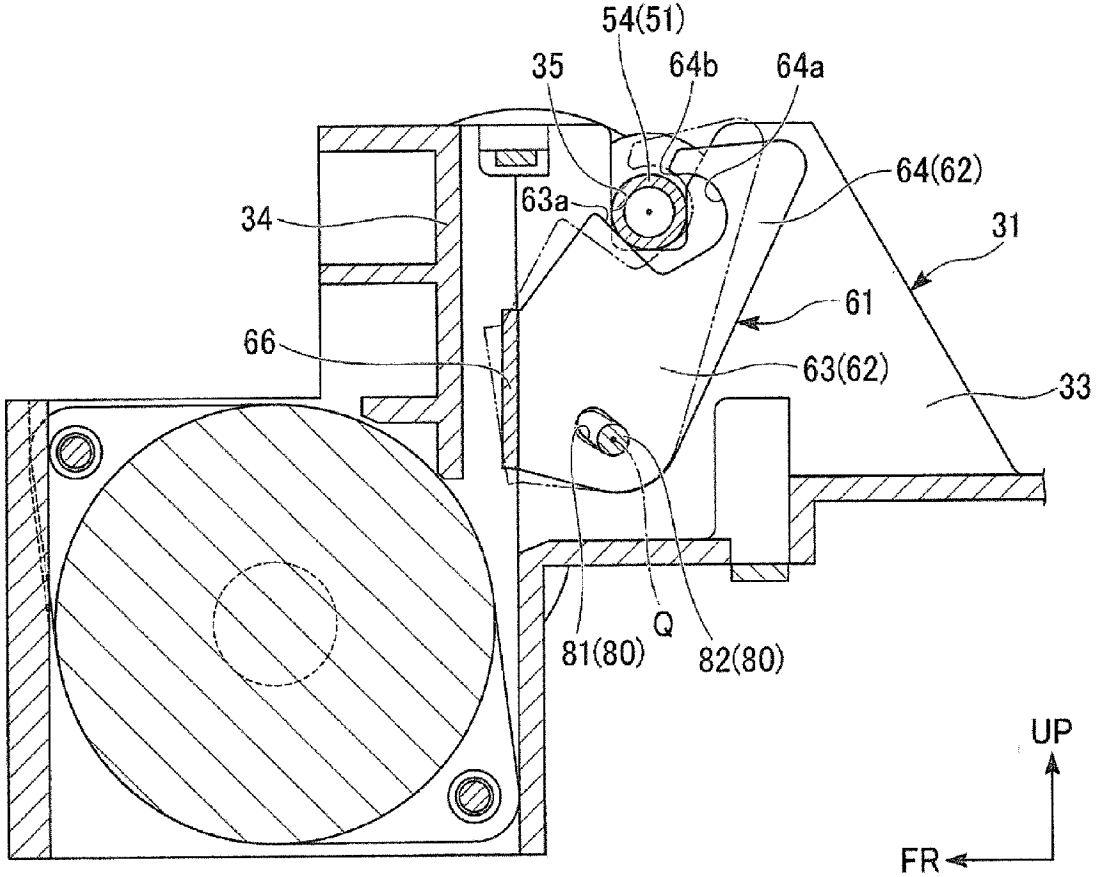
FIG. 9 is an explanatory view of the operation of the lock arm according to the first embodiment of the present invention, and is a sectional view of the part corresponding to the region taken along the line IV-IV of FIG. 3.
Figure 10:
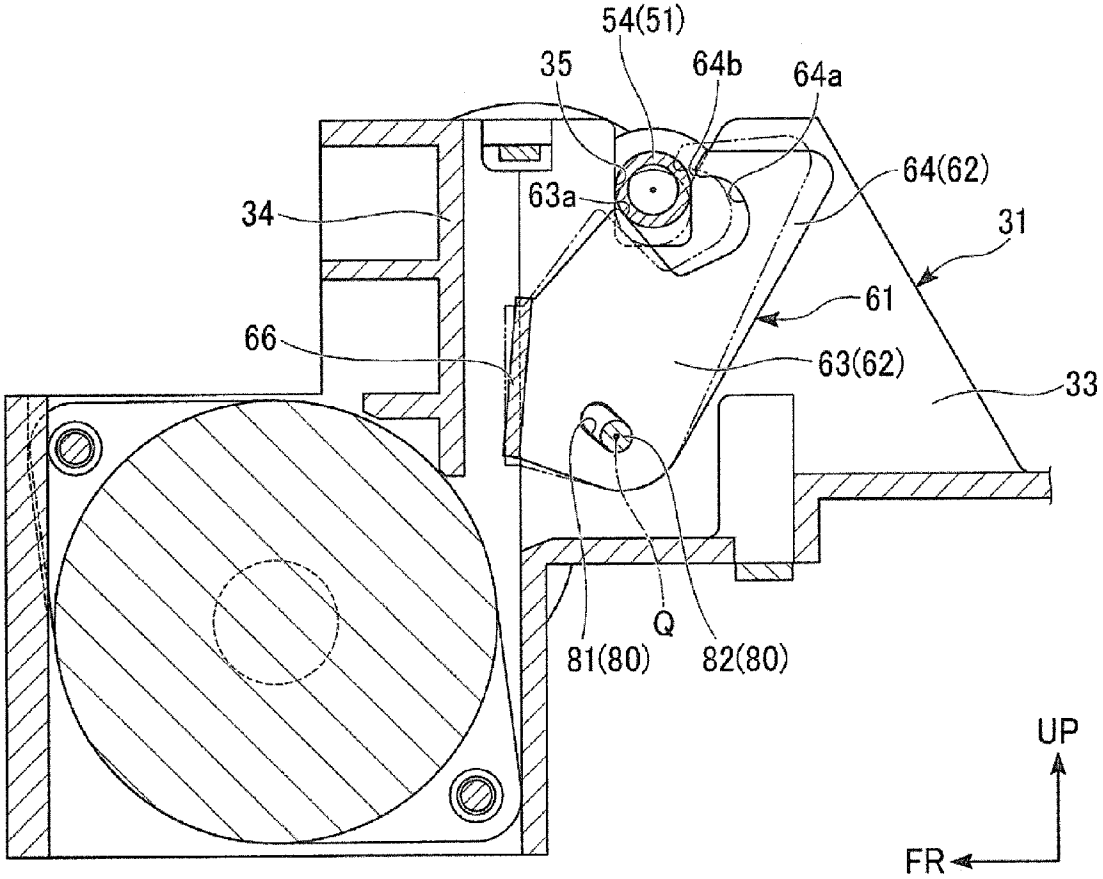
FIG. 10 is an explanatory view of the operation of the lock arm according to the first embodiment of the present invention, and is a sectional view of the part corresponding to the region taken along the line IV-IV of FIG. 3.

Now, actions of the printing unit are described. The following description is directed to an operation of removing, from the main body frame 31, the platen roller 51 mounted at the front end edge of the paper cover 20. FIG. 8 to FIG. 10 are explanatory views of an operation of the lock arm, and are sectional views of a part corresponding to the region taken along the line IV-IV of FIG. 3.

As illustrated in FIG. 4, when the lock arm 61 is in the holding state and the second shaft 82 is in a state of being located at the locking position in the elongate hole 81, the pivot of the lock arm 61 about the center axis Q is restricted. Therefore, the lock arm 61 is pivotable about a contact portion between the front end surface 64*a* of the gripping portion 64 and the bearing 54. At this time, the rear plate portion 66 of the lock arm 61 is biased in a downward direction by the first biasing member 71 and the second biasing member 72 (hereinafter sometimes referred to as "respective biasing members 71 and 72"). That is, the respective biasing members 71 and 72 bias the rear plate portion 66 downward about the contact portion between the gripping portion 64 and the bearing 54, to thereby bias the lock arm 61 in a direction in which the center axis Q (second shaft 82) is moved from the pivoting position to the locking position in the elongate hole 81. Thus, the second shaft 82 is held at the locking position in the elongate hole 81.

Next, the one end portion 90*a* of the lever 90 is pushed down so that the second coupling portion 68 of the lock arm 61 (see FIG. 6) is pushed upward opposite to the biasing direction of the respective biasing members 71 and 72. At this time, the lock arm 61 is pivotable about the contact portion between the front end surface 64*a* of the gripping portion 64 and the bearing 54 as described above, and hence the force of pushing the second coupling portion 68 upward is partially converted to a force to be applied in a direction of rotating the base portion 63 forward. As a result, as illustrated in FIG. 8, the lock arm 61 is pivoted about the contact portion between the gripping portion 64 and the bearing 54 so that the base portion 63 is moved forward. Accordingly, the center axis Q (second shaft 82) is relatively moved to the pivoting position in the elongate hole 81. Thus, the lock arm 61 becomes pivotable about the center axis Q. At this time, the rear plate portion 66 of the lock arm 61 is biased in the downward direction by the respective biasing members 71 and 72. That is, the respective biasing members 71 and 72 bias the rear plate portion 66 downward about the center axis Q, to thereby bias the gripping portion 64 in a direction of gripping the bearing 54.

Next, the one end portion 90*a* of the lever 90 is further pushed down so that the second coupling portion 68 of the lock arm 61 is further pushed upward. At this time, the lock arm 61 is pivotable about the center axis Q, and hence the lock arm 61 is pivoted so that the gripping portion 64 is moved rearward. Then, as illustrated in FIG. 9, the upper end surface 63*a* of the base portion 63 is moved obliquely toward the upper rear side so that the upper end surface 63*a* is brought into contact with the bearing 54 inserted into the roller insertion groove 35.

Next, when the one end portion 90*a* of the lever 90 is further pushed down, the lock arm 61 is pivoted about the center axis Q so that the gripping portion 64 is moved rearward. Then, as illustrated in FIG. 10, the gripping portion 64 is completely moved away from the upper side of the roller insertion groove 35. Thus, the lock arm 61 is brought into a releasing state in which the platen roller 51 is completely released from the roller insertion groove 35 to become removable. At this time, the upper end surface 63*a* of the base portion 63 is further moved obliquely toward the upper rear side so that the bearing 54 inserted into the roller insertion groove 35 is lifted upward. As a result, the platen roller 51 is removable from the roller insertion groove 35. The paper cover 20 disengages from the casing 3 having the main body frame 31 mounted therein to move from the closed position (see FIG. 1) to the opened position (see FIG. 2). Through the procedure described above, the operation of removing the platen roller 51 from the main body frame 31 is finished.

As described above, the printing unit 30 of the first embodiment includes: the main body frame 31; the thermal head 41; the platen roller 51 arranged so as to be opposed to the thermal head 41, which is configured to convey the recording sheet P by rotating about the axis extending along the lateral direction under a state in which the recording sheet P is nipped between the platen roller 51 and the thermal head 41; the roller insertion grooves 35 formed in the main body frame 31, into which the platen roller 51 is inserted in a state of being removable from the roller insertion grooves 35 along the vertical direction; the lock arm 61 supported so as to be pivotable about the center axis Q, which is configured to hold the platen roller 51 inserted into the roller insertion grooves 35; the moving mechanism 80 configured to move the pivot axis (center axis Q); and the respective biasing members 71 and 72 configured to bias the lock arm 61. The lock arm 61 has the gripping portions 64 extending from a region opposite to the thermal head 41 across the platen roller 51 toward the thermal head 41 under the holding state. The distal end portion 64*b* of each of the gripping portions 64 is formed so as to be located close to the thermal head 41 side with respect to the imaginary plane F including the center axis P of the platen roller 51 and the center axis Q under the holding state. The moving mechanism 80 is configured to move the center axis Q between the locking position where the pivot of the lock arm 61 is restricted under the holding state and the pivoting position where the lock arm 61 is freely pivotable between the holding state and the releasing state in which the platen roller 51 is removable from the roller insertion grooves 35. The respective biasing members 71 and 72 are configured to: bias the lock arm 61 in a direction in which the center axis Q is moved from the pivoting position to the locking position under the holding state; and bias the lock arm 61 in a direction in which the lock arm 61 is shifted from the releasing state to the holding state under a state in which the center axis Q is located at the pivoting position.

According to this structure, the lock arm 61 is biased by the respective biasing members 71 and 72 so as to maintain the holding state, and is also biased so that the center axis Q is located at the locking position under the holding state. Therefore, to release the platen roller 51, the lock arm 61 configured to hold the platen roller 51 requires two-stage operations, namely an operation of moving the center axis Q to the pivoting position by the moving mechanism 80, and an operation of releasing the platen roller 51 by pivoting about the center axis Q. Thus, the platen roller 51 is less liable to drop off from the roller insertion grooves 35 even when an external force is applied to the lock arm 61. Further, the distal end portion 64*b* of each of the gripping portions 64 is formed so as to be located close to the thermal head 41 side with respect to the imaginary plane F including the center axis P of the platen roller 51 and the center axis Q under the holding state, thereby being capable of suppressing the drop of the platen roller 51 more securely. Thus, it is possible to attain a printing unit capable of stably holding the platen roller 51.

Further, in the printing unit 30 of the first embodiment, the lock arm 61 is configured to pivot in a direction away from the thermal head 41, thereby downsizing the device and enhancing the layout efficiency. On the thermal head 41 side of the main body frame 31, a large number of components such as the driving means 58 and the gear transmission mechanism 57 are arranged in addition to the thermal head 41. Thus, in a case where the lock arm 61 is configured to pivot toward the thermal head 41 side, a space for avoiding interference with those components needs to be secured, resulting in upsizing of the device. In the printing unit 30 of the first embodiment, this trouble is avoided with the above-mentioned structure.

Further, in the printing unit 30 of the first embodiment, the moving mechanism 80 includes: the elongate holes 81 formed in the lock arm 61; and the second shaft 82 fixed to the main body frame 31 and fitted to the elongate holes 81. According to this structure, the second shaft 82 (center axis Q) is relatively moved along a longitudinal direction of each of the elongate holes 81, thereby being capable of shifting between the pivoting position and the locking position. Thus, it is possible to easily form the moving mechanism 80 configured to move the position of the center axis Q with respect to the lock arm 61.

Further, in the printing unit 30 of the first embodiment, a part of the each of the gripping portions 64 to be brought into contact with the bearing 54 of the platen roller 51 is formed into an arc shape conforming to the outer peripheral surface of the platen roller 51 when viewed in the lateral direction. According to this structure, the gripping portions 64 hold the platen roller 51 while being brought into contact with a wide region on the outer peripheral surface of the platen roller 51, thereby being capable of holding the platen roller 51 more stably. Further, the platen roller 51 is held by the arc-shaped part of each of the gripping portions 64 so that the rotational locus of the distal end portion 64*b* of each of the gripping portions 64 interferes with the platen roller 51 under a state in which the center axis Q is located at the locking position, thereby being capable of easily forming the structure for restricting the pivot of the lock arm 61.

Further, the thermal printer 1 of the first embodiment includes the printing unit 30. According to this structure, it is possible to attain a thermal printer capable of stably holding the platen roller 51 and resistant to an external force caused by drop impact or the like.

The present invention is not limited to the first embodiment described above with reference to the drawings, and various modified examples may be employed within the technical scope of the present invention. For example, in the first embodiment described above, the lever 90 is used for the operation of removing the platen roller 51, but the present invention is not limited thereto. For example, a link mechanism, a cam mechanism, or the like may be used instead.

Further, in the first embodiment described above, the moving mechanism 80 is formed by the elongate hole 81 formed in the lock arm 61 and the second shaft 82 fixed to the main body frame 31, but the present invention is not limited thereto. For example, the moving mechanism 80 may be formed by a shaft portion fixed to the lock arm 61 and an elongate hole formed in the main body frame 31.

Further, in the first embodiment described above, a cushioning member may be arranged around the casing 3 or between the casing 3 and the main body frame 31. Thus, the influence of the drop impact or the like can further be reduced.

Second Embodiment

Now, a second embodiment of the present invention is described with reference to the accompanying drawings. In the second embodiment, the same members as those of the first embodiment described above are represented by the same reference symbols, and description thereof is omitted.

Figure 11:
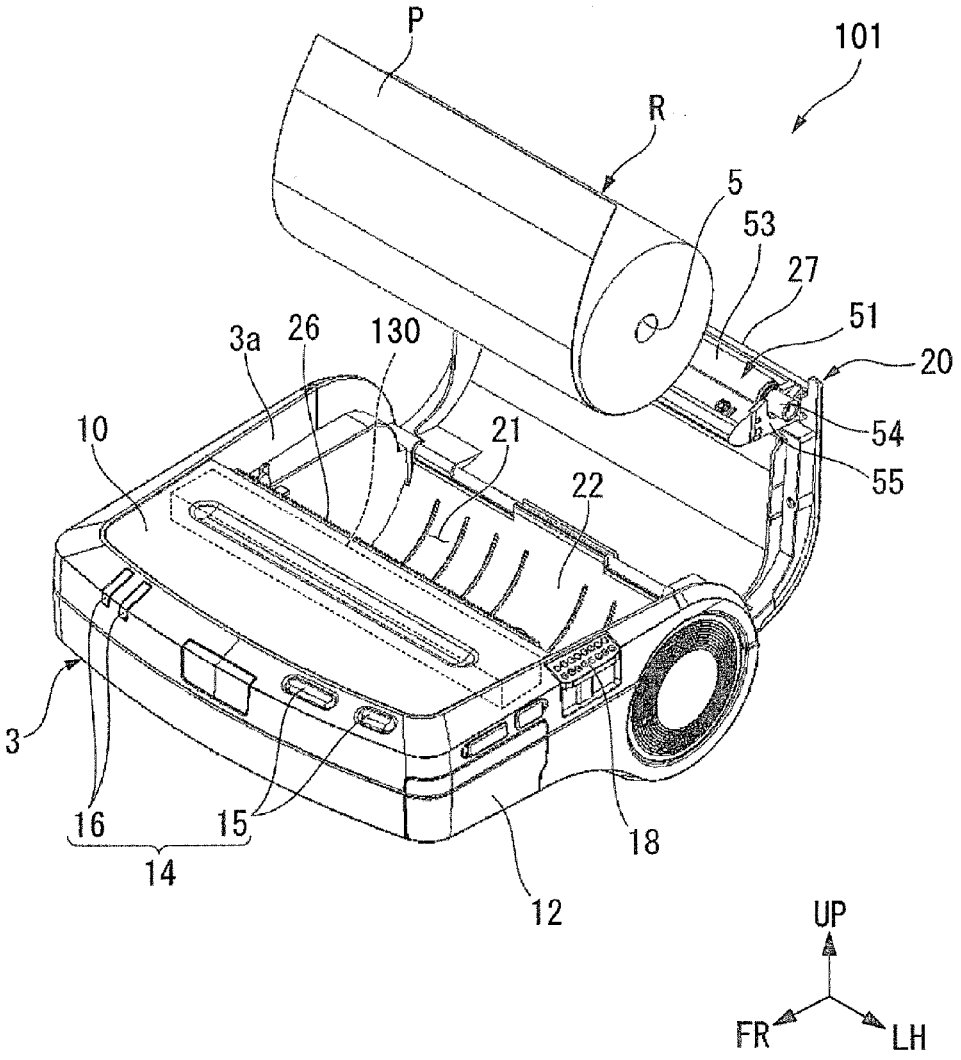
FIG. 11 is a perspective view of a thermal printer according to a second embodiment of the present invention, for illustrating a state in which a paper cover is located at an opened position.

FIG. 11 is a perspective view of a thermal printer at the time when a paper cover is located at an opened position. The thermal printer is used in a state of being placed on a mounting surface. In the figures, the arrow UP is defined as an upper side, the arrow FR is defined as a front side, and the arrow LH is defined as a left side.

A thermal printer 101 includes a casing 3 having an opening portion 3*a*, a paper cover 20 supported on the casing 3 in a pivotable manner and configured to open and close the opening portion 3*a* of the casing 3, and a printing unit 130.

A roll sheet receiving portion 21, in which a roll sheet R is received through the opening portion 3*a*, is defined in a rear part of the casing 3. The roll sheet receiving portion 21 includes a guide plate 22 configured to hold the roll sheet R. The guide plate 22 and an inner surface of the paper cover 20 hold the roll sheet R therebetween so as to cover the roll sheet R. The guide plate 22 is formed into an arc shape in cross section when viewed in the lateral direction. The guide plate 22 is configured to hold the roll sheet R under a state in which an outer peripheral surface of the roll sheet R is held in contact with an inner peripheral surface of the guide plate 22, and to guide a recording sheet P drawn out from the roll sheet R to the printing unit 130.

The paper cover 20 is engageable at its front end with a main body frame 131 (see FIG. 12) of the printing unit 130 described later by a platen roller 51 described later, which is mounted on the front end.

Figure 12:
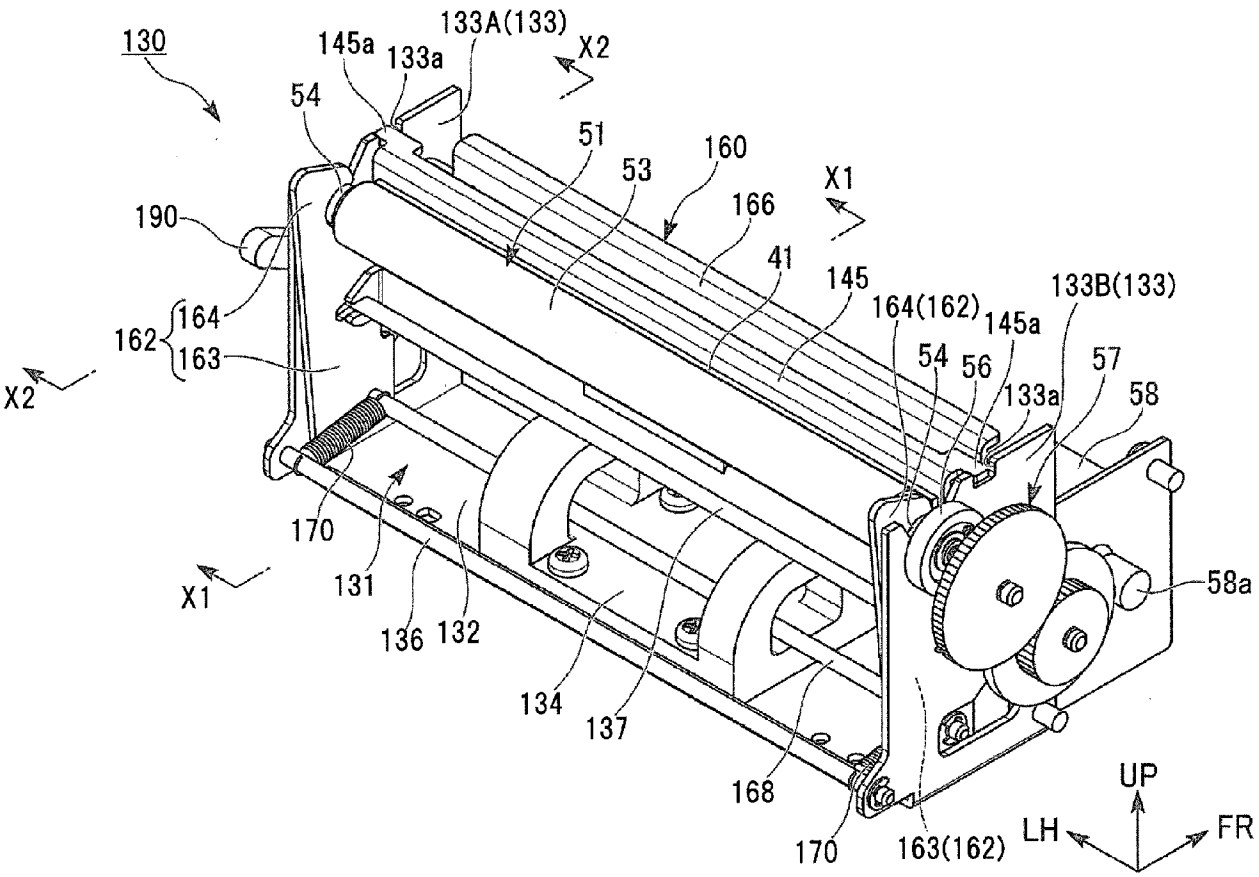
FIG. 12 is a perspective view of a printing unit according to the second embodiment of the present invention when viewed from a rear side of the printing unit.
Figure 13:
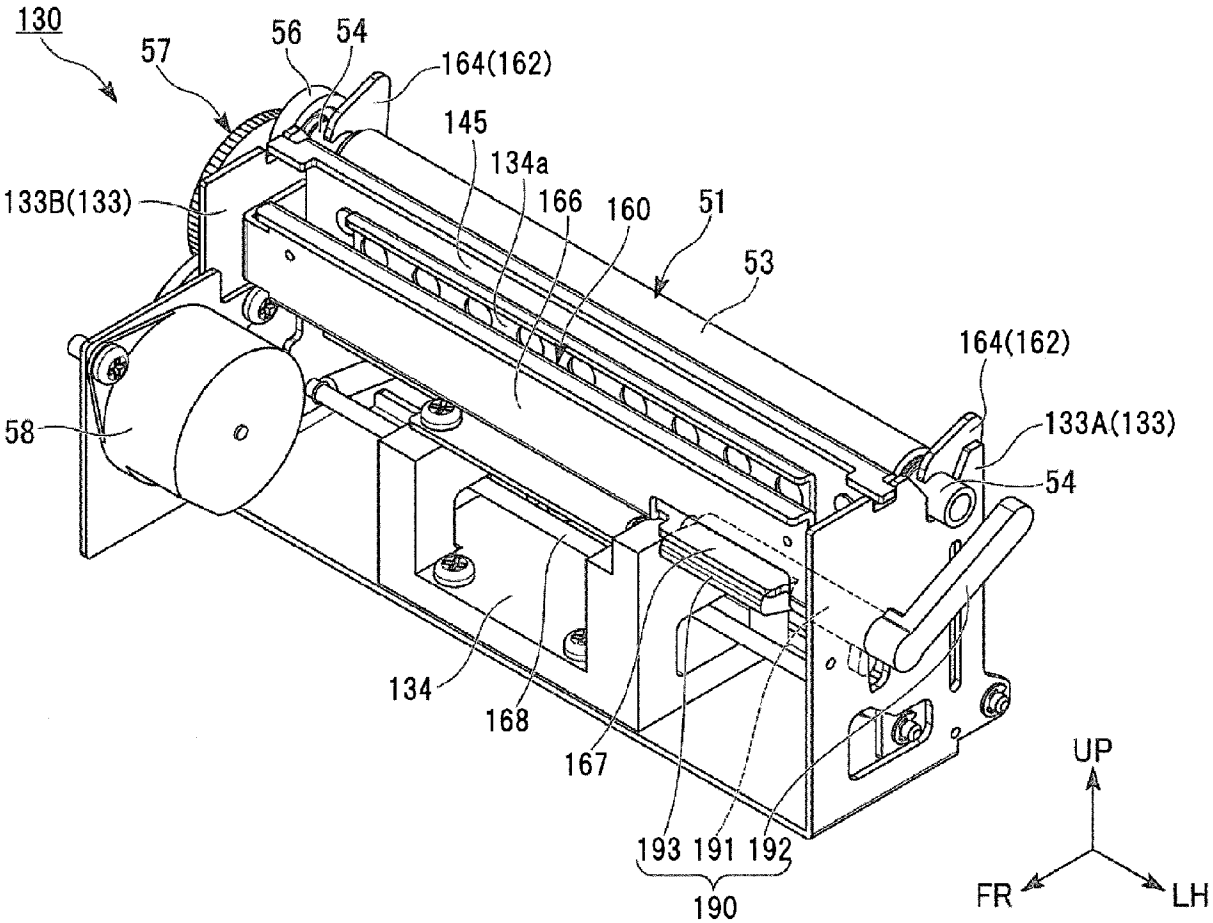
FIG. 13 is a perspective view of the printing unit according to the second embodiment of the present invention when viewed from a front side of the printing unit.
Figure 14:
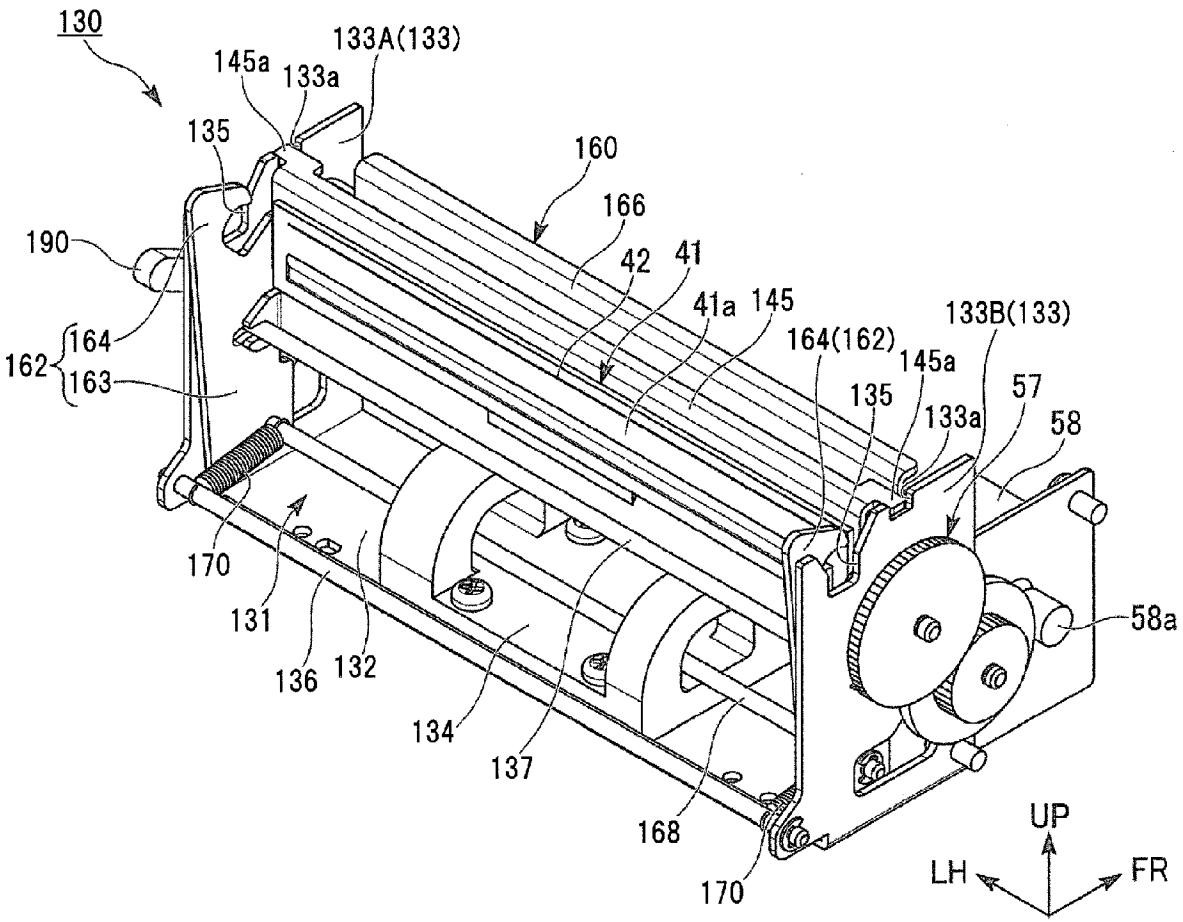
FIG. 14 is a perspective view of the printing unit according to the second embodiment of the present invention when viewed from the rear side of the printing unit under a state in which a platen roller is removed.
Figure 15:
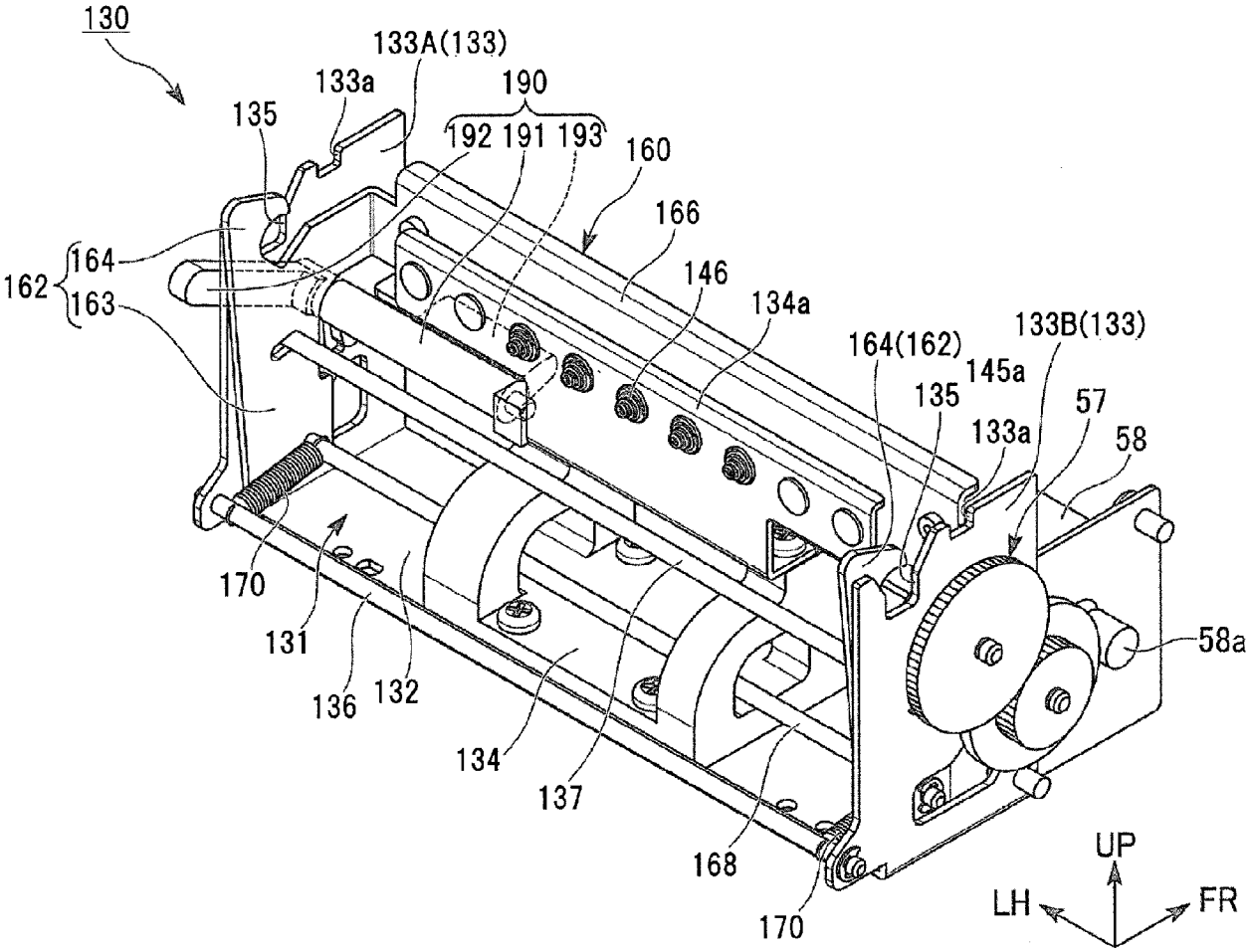
FIG. 15 is a perspective view of the printing unit according to the second embodiment of the present invention when viewed from the rear side of the printing unit under a state in which the platen roller and a thermal head are removed.

FIG. 12 is a perspective view of the printing unit when viewed from a rear side of the printing unit. FIG. 13 is a perspective view of the printing unit when viewed from a front side of the printing unit. FIG. 14 is a perspective view of the printing unit when viewed from the rear side of the printing unit under a state in which the platen roller is removed. FIG. 15 is a perspective view of the printing unit when viewed from the rear side of the printing unit under a state in which the platen roller and a thermal head are removed. As illustrated in FIG. 12, the printing unit 130 includes the main body frame 131, a thermal head 41, the platen roller 51, and a lock mechanism 160.

The main body frame 131 is formed by bending a plate member made of metal or the like. The main body frame 131 has a U-shape opened upward when viewed in the fore-and-aft direction. Specifically, the main body frame 131 includes a bottom portion 132 extending in the lateral direction, a pair of side wall portions 133, namely a left side wall portion 133A and a right side wall portion 133B formed upright from both sides of the bottom portion 132 in the lateral direction toward the upper side, and a support portion 134 arranged on an upper surface of the bottom portion 132. The bottom portion 132 of the main body frame 131 is fixed onto a base member (not shown) arranged inside the casing 3.

As illustrated in FIG. 14, roller insertion grooves 135 cut downward are formed in upper end edges of the respective side wall portions 133. The platen roller 51 is inserted into the roller insertion grooves 135 so as to be removable from the roller insertion grooves 135 along the vertical direction (see FIG. 12). As illustrated in FIG. 12 and FIG. 13, driving means 58 such as a motor is mounted on the right side wall portion 133B. The driving means 58 is mounted on an inner side of the right side wall portion 133B, and an output shaft 58*a* of the driving means 58 protrudes outward from the main body frame 131 through the right side wall portion 133B.

As illustrated in FIG. 15, the support portion 134 is a rectangular member in plain view, and is formed so that both end portions of the support portion 134 in the lateral direction protrude upward. A head pressing plate 134*a* is fixed to an upper part of the support portion 134. The head pressing plate 134*a* is a plate-like member having its longitudinal direction defined as the lateral direction. The head pressing plate 134*a* is arranged between the pair of side wall portions 133.

As illustrated in FIG. 12, a first shaft 136 extending in the lateral direction is arranged at a lower rear part of the main body frame 131. Both end portions of the first shaft 136 are fixed to the pair of side wall portions 133, respectively. A second shaft 137 extending along the lateral direction, which corresponds to the "pivot shaft" in the claims, is arranged at a part of the main body frame 131 located obliquely on an upper front side with respect to the first shaft 136. Similarly to the first shaft 136, both end portions of the second shaft 137 are fixed to the pair of side wall portions 133, respectively.

Figure 16:
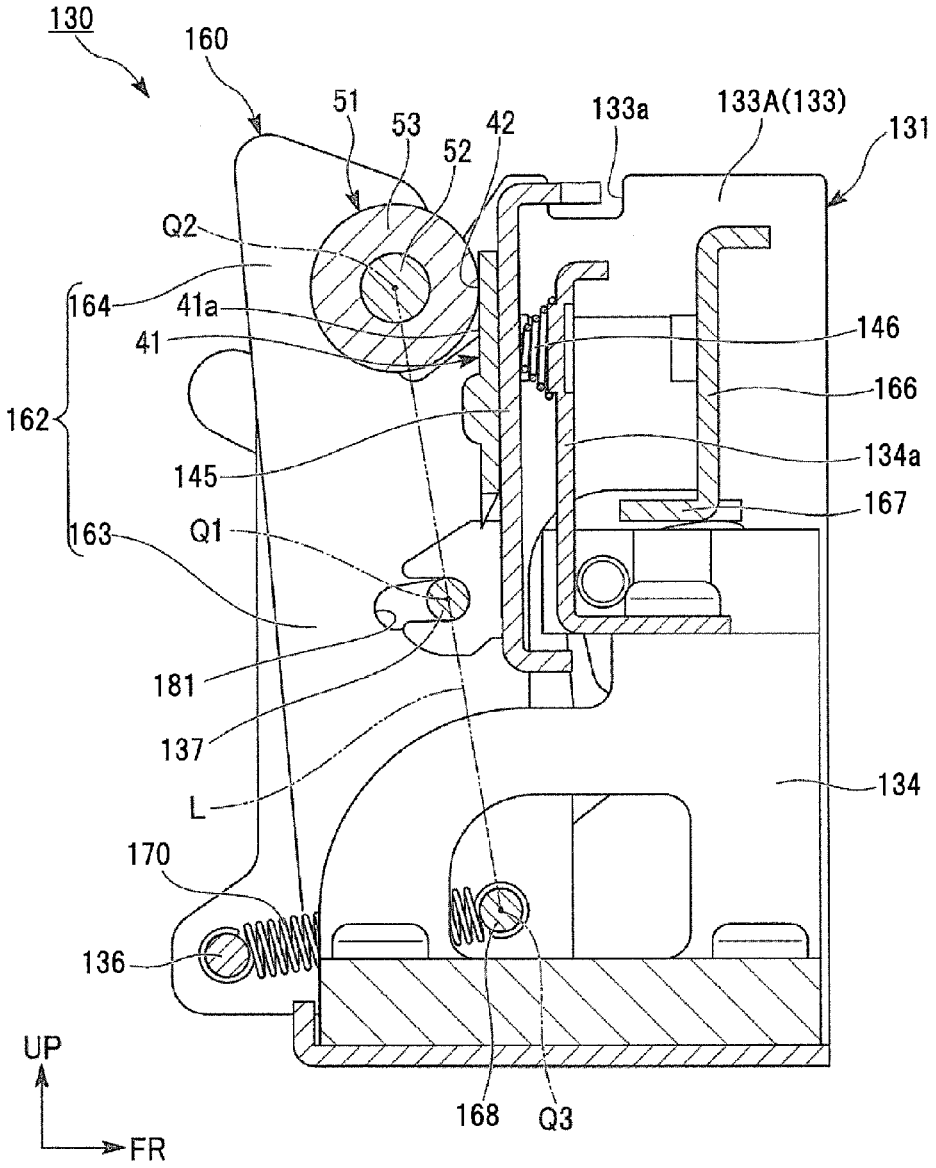
FIG. 16 is a sectional view taken along the line X1-X1 of FIG. 12.

FIG. 16 is a sectional view taken along the line X1-X1 of FIG. 12. The thermal head 41 is bonded and fixed onto a head support member 145 supported on the main body frame 131. The head support member 145 is a plate-like member having its longitudinal direction defined as the lateral direction. The head support member 145 is arranged between the pair of side wall portions 133, and the thermal head 41 is bonded and fixed onto a rear surface of the head support member 145. The head support member 145 is arranged behind the head pressing plate 134*a*, and a lower part of the head support member 145 is supported on the second shaft 137 in a pivotable manner. As illustrated in FIG. 15 and FIG. 16, elastic members 146 configured to bias the head support member 145 and the head pressing plate 134*a* in directions away from each other are interposed between the head support member 145 and the head pressing plate 134*a*. That is, the elastic members 146 are configured to press the head support member 145 constantly rearward. A plurality of (in the second embodiment, five) elastic members 146 are arrayed in the lateral direction with intervals secured therebetween.

As illustrated in FIG. 14, stoppers 145*a* configured to regulate a pivot range of the head support member 145 are formed at upper end portions of the head support member 145. Each stopper 145*a* extends outward in the lateral direction of the head support member 145, and faces an inside of a recessed portion 133*a* formed in an upper part of the side wall portion 133 of the main body frame 131. The stopper 145*a* is configured to move inside the recessed portion 133*a* along with the pivot of the head support member 145, and may be brought into contact with both end surfaces of the recessed portion 133*a* in the fore-and-aft direction. Through the contact of the stopper 145*a* with the end surfaces of the recessed portion 133*a*, the pivot amount of the head support member 145 is regulated.

As illustrated in FIG. 12 and FIG. 16, a roller shaft 52 is formed slightly longer than the separation distance between the pair of side wall portions 133 of the main body frame 131. A roller main body 53 is made of, for example, rubber, and is arranged along an axial direction (lateral direction) of the roller shaft 52 uniformly over the entire region excluding portions corresponding to both ends of the roller shaft 52.

As illustrated in FIG. 11, the platen roller 51 is mounted in a freely pivotable manner at a front end edge of the paper cover 20 through intermediation of a platen frame 55, and is removable from the main body frame 131 along with the opening and closing operation of the paper cover 20. As illustrated in FIG. 12, under a state in which the paper cover 20 is located at a closed position, a pair of bearings 54 of the platen roller 51, which are mounted at both ends of the platen roller 51, are inserted into the roller insertion grooves 135 of the main body frame 131, respectively (see FIG. 14). The platen roller 51 is arranged so that the roller main body 53 is brought into contact with the thermal head 41 under the state in which the platen roller 51 is inserted into the roller insertion grooves 135 and the recording sheet P drawn out from the roll sheet R is nipped between the platen roller 51 and the thermal head 41. Further, a driven gear 56 meshes with a gear transmission mechanism 57 mounted on the main body frame 131 when the platen roller 51 is held on the pair of side wall portions 133.

Figure 17:
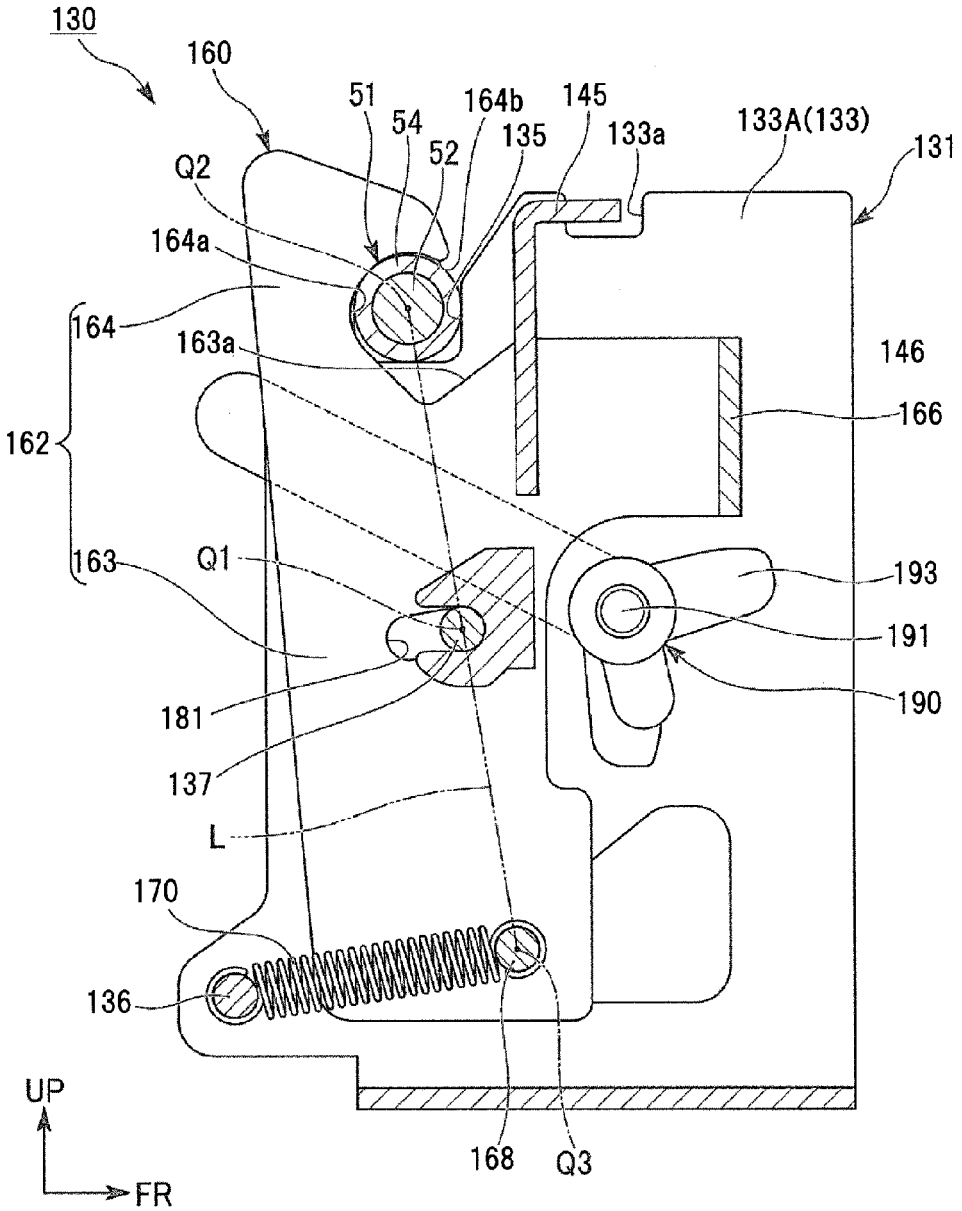
FIG. 17 is an explanatory view of a lock mechanism according to the second embodiment of the present invention, which is located at a locking position.
Figure 18:
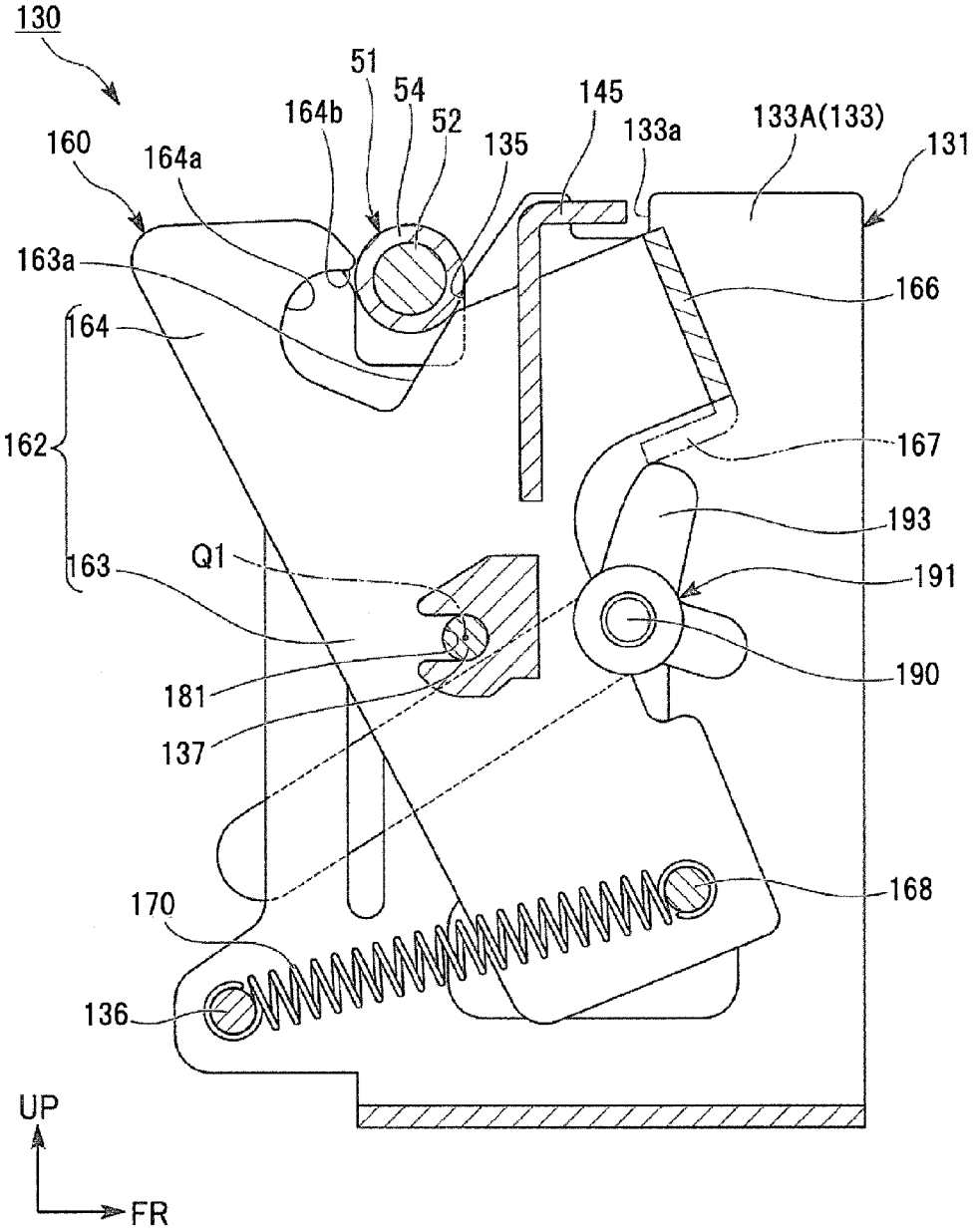
FIG. 18 is an explanatory view of the lock mechanism according to the second embodiment of the present invention, which is located at an unlocking position.

FIG. 17 is an explanatory view of the lock mechanism located at a locking position, and is a sectional view taken along the line X2-X2 of FIG. 12. FIG. 18 is an explanatory view of the lock mechanism located at an unlocking position, and is a sectional view of a part corresponding to the region taken along the line X2-X2 of FIG. 12. As illustrated in FIG. 12 and FIG. 17, the lock mechanism 160 is supported on the second shaft 137 in a pivotable manner, and is configured to hold the platen roller 51 inserted into the roller insertion grooves 135. In the second embodiment, the lock mechanism 160 is pivoted between the locking position where the platen roller 51 is held on the main body frame 131 in a rotatable manner as illustrated in FIG. 17 and the unlocking position where the platen roller 51 is detachable from the main body frame 131 as illustrated in FIG. 18. The lock mechanism 160 includes a pair of lock arms 162 configured to hold the bearings 54 of the platen roller 51, respectively, and a coupling plate 166 coupling the pair of lock arms 162. The pair of lock arms 162 are formed into the same shape, and hence only one of the lock arms 162 is described below. Unless otherwise noted, the following description of the structure of the lock mechanism 160 is directed to a state in which the lock mechanism 160 is located at the locking position as illustrated in FIG. 17.

As illustrated in FIG. 13, the coupling plate 166 is formed into a plate shape having its thickness direction defined as the fore-and-aft direction and extending along the lateral direction. The coupling plate 166 is arranged in front of the head pressing plate 134*a* at a position between the pair of side wall portions 133 of the main body frame 131. The coupling plate 166 includes a lever abutment portion 167 formed at a lower left end portion thereof. The lever abutment portion 167 has its lower surface extended along the fore-and-aft direction and the lateral direction, and a second operation piece 193 of a releasing lever 190 described later is brought into abutment against the lever abutment portion 167.

As illustrated in FIG. 17, the pair of lock arms 162 are flat plate-like members, and are individually protruded rearward from both end portions of the coupling plate 166 in the lateral direction. Each lock arm 162 includes a base portion 163 arranged below the roller insertion groove 135 when viewed in the lateral direction, and a gripping portion 164 extending upward from an upper-end rear part of the base portion 163.

A shaft hole 181 is formed in a center part of the base portion 163 in the vertical direction. The shaft hole 181 is formed into an oblong shape having its longitudinal direction defined as a direction orthogonal to a straight line L passing through a center axis Q2 of the platen roller 51 and a center axis Q1 of the second shaft 137 when viewed in the lateral direction.

The second shaft 137 is inserted into the shaft hole 181. With the shaft hole 181 and the second shaft 137, the lock mechanism 160 is pivoted about the second shaft 137. The lock mechanism 160 is slidable relative to the second shaft 137 within a range of the shaft hole 181. When the lock mechanism 160 is located at the locking position, the second shaft 137 is brought into abutment against a front end edge in the shaft hole 181 to achieve the state illustrated in FIG. 17, and when the lock mechanism 160 is located at the unlocking position, the second shaft 137 is brought into abutment against a rear end edge in the shaft hole 181 to achieve the state illustrated in FIG. 18.

A third shaft 168 is mounted at a lower part of the base portion 163. The third shaft 168 is arranged in front of the first shaft 136 along the lateral direction, and both end portions of the third shaft 168 are fixed to the pair of base portions 163, respectively. A center axis Q3 of the third shaft 168 is arranged on the straight line L when viewed in the lateral direction.

The gripping portion 164 extends in the fore-and-aft direction from a region opposite to the thermal head 41 side across the platen roller 51 toward the thermal head 41 side through an upper side of the platen roller 51 (see FIG. 16). A front end surface 164*a* of the gripping portion 164, which is a part connected to an upper end surface of the base portion 163, extends obliquely toward the upper rear side, and then extends while being curved toward the front side. The curved part of the front end surface 164*a* is formed into an arc shape conforming to an outer peripheral surface of the bearing 54 of the platen roller 51 when viewed in the lateral direction. The curved part of the front end surface 164*a* is brought into contact with the bearing 54 so that the lock mechanism 160 sandwiches the bearing 54 between the front end surface 164*a* and an inner peripheral edge of the roller insertion groove 135, to thereby hold the bearing 54 in the roller insertion groove 135.

A distal end portion 164*b* of the gripping portion 164 (front end of the front end surface 164*a*) is formed so as to be located close to the thermal head 41 side (front side) with respect to the straight line L when viewed in the lateral direction. The distal end portion 164*b* is formed so that the closest proximity distance between the distal end portion 164*b* and the upper end surface of the base portion 163 is longer than the outer diameter of the bearing 54.

Further, the distal end portion 164*b* is formed so that, under a state in which the lock mechanism 160 is located at the locking position, the distance between the distal end portion 164*b* and the center axis Q1 of the second shaft 137 is shorter than the longest distance between the center axis Q1 of the second shaft 137 and the outer peripheral surface of the bearing 54. Thus, the distal end portion 164*b* is brought into contact with the bearing 54 from the front side so that the pivot of the lock arm 162 about the second shaft 137 (center axis Q1) is restricted. Further, the distal end portion 164*b* is formed so that, under a state in which the second shaft 137 is brought into abutment against the rear end edge in the shaft hole 181 as illustrated in FIG. 18, the distance between the distal end portion 164*b* and the center axis Q1 of the second shaft 137 is longer than the longest distance between the center axis Q1 of the second shaft 137 and the outer peripheral surface of the bearing 54. Thus, the lock arm 162 is pivotable about the second shaft 137 (center axis Q1) while keeping the distal end portion 164*b* out of contact with the bearing 54.

As illustrated in FIG. 12, a pair of biasing members 170 is interposed between the first shaft 136 and the third shaft 168. The pair of biasing members 170 are extended in the fore-and-aft direction along inner side surfaces of the pair of base portions 163, respectively. As illustrated in FIG. 17, each biasing member 170 is, for example, a coil spring to bias the first shaft 136 and the third shaft 168 in directions of approaching each other. Thus, the biasing member 170 biases the lock mechanism 160 toward the locking position, namely in a direction in which the gripping portion 164 is moved forward about the second shaft 137. The biasing direction of the biasing member 170 is set orthogonal to the straight line L when viewed in the lateral direction. That is, the biasing direction of the biasing member 170 matches with the longitudinal direction of the above-mentioned shaft hole 181.

As illustrated in FIG. 13, the releasing lever 190 configured to release the mounting state between the platen roller 51 and the main body frame 131 in association with an operation of an open button 18 is arranged at the left side wall portion 133A of the main body frame 131. The releasing lever 190 is supported between the left side wall portion 133A and the support portion 134, and is mounted so as to be freely pivotable about an axis extending along the lateral direction. The releasing lever 190 integrally includes a shaft portion 191 extending in the lateral direction, a first operation piece 192 extending rearward from the shaft portion 191 at a position on an outer side of the left side wall portion 133A, and the second operation piece 193 extending forward from the shaft portion 191 at a position on an inner side of the left side wall portion 133A. The first operation piece 192 is linked to the open button 18 from the lower side so as to be pushed down along with depression of the open button 18. The second operation piece 193 is linked to the lever abutment portion 167 of the lock mechanism 160 from the lower side so as to be pushed up along with the depression of the open button 18. When viewed from the left side, the releasing lever 190 is pivoted clockwise along with the depression of the open button 18 to push up the lever abutment portion 167 of the lock mechanism 160 through intermediation of the second operation piece 193. Thus, the lock mechanism 160 is shifted toward the unlocking position (see FIG. 18).

Next, actions of the above-mentioned printing unit 130 are described. First, an operation of closing the paper cover 20 is described. It is assumed that, when the paper cover 20 is located at the opened position, the lock mechanism 160 is located at the above-mentioned locking position. As illustrated in FIG. 11, the roll sheet R is loaded into the roll sheet receiving portion 21, and then the paper cover 20 is closed. Then, the bearings 54 of the platen roller 51 are first brought into contact with the gripping portions 164 of the lock arms 162 from the upper side, individually, and the outer peripheral surface of the roller main body 53 is brought into contact with the thermal head 41.

When the paper cover 20 is further pushed in the closing direction, the bearings 54 of the platen roller 51 press the lock mechanism 160 toward the unlocking position, namely in a direction opposite to the direction of biasing forces of the biasing members 170 through intermediation of the gripping portions 164. Further, the outer peripheral surface of the roller main body 53 presses the head support member 145 through intermediation of the thermal head 41 so that the platen roller 51 pivots the head support member 145 about the second shaft 137 in a direction opposite to the direction of biasing forces of the elastic members 146. Thus, the bearings 54 individually enter the roller insertion grooves 135 of the main body frame 131 while expanding the gap between the gripping portions 164 and the thermal head 41 in the fore-and-aft direction.

After that, when the bearings 54 have climbed over the distal end portions 164*b* of the gripping portions 164, the lock mechanism 160 is pivoted toward the locking position due to restoring forces of the biasing members 170. Thus, each of the bearings 54 is held between the front end surface 164*a* of the gripping portion 164 and the inner peripheral edge of the roller insertion groove 135 so that the platen roller 51 is held on the main body frame 131 in a rotatable manner, and the paper cover 20 is located at the closed position. In this state, the driven gear 56 of the platen roller 51 meshes with the gear transmission mechanism 57 mounted on the main body frame 131. Through the procedure described above, the operation of closing the paper cover 20 is finished.

Figure 19:
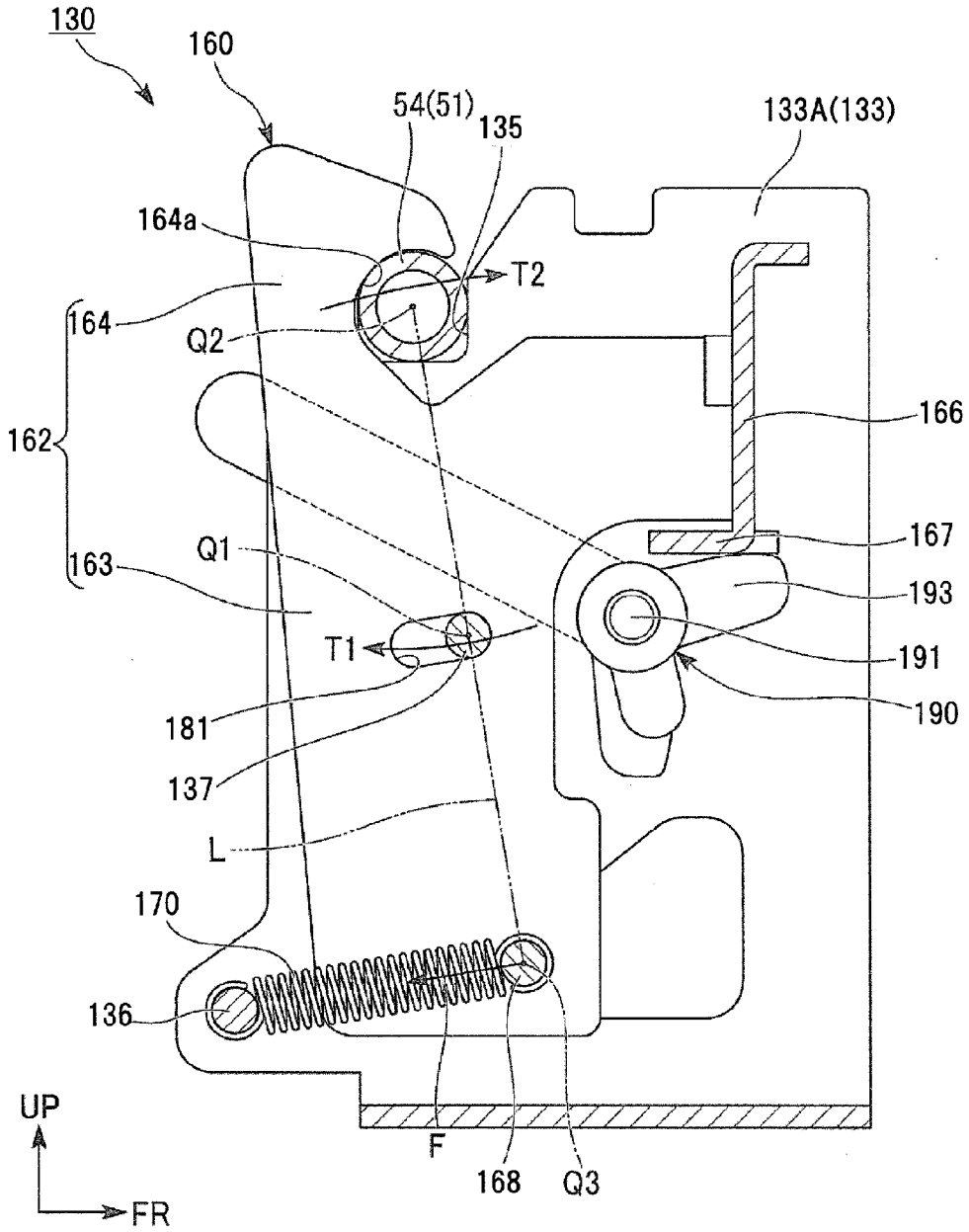
FIG. 19 is an explanatory view of an operation of the printing unit according to the second embodiment of the present invention.

FIG. 19 is an explanatory view of an operation of the printing unit, and is a sectional side view for mainly illustrating the left side wall portion 133A of the main body frame 131, the bearing 54 of the platen roller 51, and the lock mechanism 160. As illustrated in FIG. 19, the lock mechanism 160 is biased toward the locking position by the biasing member 170 as described above. Specifically, at the locking position, the curved part of the front end surface 164*a* of the gripping portion 164 of the lock mechanism 160 is held in contact with the bearing 54 of the platen roller 51. Therefore, a first torque T1 directed toward the locking position, namely in a direction in which the base portion 163 is moved rearward about a contact portion between the front end surface 164*a* of the gripping portion 164 and the bearing 54 is generated in the lock mechanism 160. The curved part of the front end surface 164*a* of the gripping portion 164 is formed in conformity with the outer peripheral surface of the bearing 54. Therefore, the rotational center of the first torque T1 substantially matches with the center axis Q2 of the bearing 54 (platen roller 51).

Thus, at the locking position, the lock mechanism 160 maintains an abutment state in which the front end edge of the shaft hole 181 is brought into abutment against the second shaft 137 from the front side. That is, the abutment state between the second shaft 137 and the shaft hole 181 is maintained by a biasing force F of the biasing member 170 (first torque T1), thereby being capable of suppressing the movement of the lock mechanism 160 relative to the second shaft 137 within the range of the shaft hole 181.

Further, when the lock mechanism 160 is located at the locking position, namely under the abutment state between the second shaft 137 and the front end portion of the opening edge of the shaft hole 181, a second torque T2 directed toward the locking position about the center axis Q1 of the second shaft 137 is generated in the lock mechanism 160 due to the biasing force F of the biasing member 170. With the second torque T2, the gripping portion 164 of the lock mechanism 160 is biased forward to hold the bearing 54 of the platen roller 51 and bring the outer peripheral surface of the platen roller 51 into press contact with the thermal head 41 (see FIG. 16).

In the second embodiment, the longitudinal direction of the shaft hole 181 matches with the direction orthogonal to the straight line L when viewed in the lateral direction. That is, the longitudinal direction of the shaft hole 181 matches with a tangential direction of an imaginary circle passing through the center axis Q1 of the second shaft 137 with its center defined at the center axis Q2 of the platen roller 51 when viewed in the lateral direction. On the other hand, the biasing force F of the biasing member 170 is applied to the third shaft 168. The biasing direction of the biasing member 170 matches with a direction orthogonal to a straight line connecting the center axis Q2 of the platen roller 51 and the center axis Q3 of the third shaft 168 (straight line L) when viewed in the lateral direction. Therefore, all of the biasing force F of the biasing member 170 is converted to the first torque T1 to serve as a pressing force to be applied between the second shaft 137 and the shaft hole 181 at the contact portion between the second shaft 137 and the shaft hole 181. Besides, the shaft hole 181 is an elongate hole, and hence the movement of the second shaft 137 in the shaft hole 181 in a transverse direction of the shaft hole 181 is restricted, thereby stabilizing the position of the second shaft 137 in the shaft hole 181.

Further, the biasing direction of the biasing member 170 matches with a direction orthogonal to a straight line connecting the center axis Q1 of the second shaft 137 and the center axis Q3 of the third shaft 168 (straight line L) when viewed in the lateral direction. Therefore, all of the biasing force F of the biasing member 170 is converted to the second torque T2 to serve as a pressing force to be applied between the gripping portion 164 and the bearing 54 of the platen roller 51. Thus, the biasing force F of the biasing member 170 can efficiently be applied for positioning the second shaft 137 with respect to the shaft hole 181 and holding the platen roller 51 by the gripping portion 164.

Next, an operation of opening the paper cover 20 is described. When the open button 18 is first depressed, the releasing lever 190 is pivoted in association with the depression of the open button 18. Thus, the lock mechanism 160 is pressed toward the unlocking position, namely in the direction opposite to the direction of the biasing forces of the biasing members 170 through intermediation of the second operation piece 193. Specifically, the lock mechanism 160 is pivoted about the contact portions between the front end surfaces 164*a* of the gripping portions 164 and the bearings 54 so that the rear end edges of the shaft holes 181 are slid so as to approach the second shaft 137. Thus, the lock mechanism 160 is pushed upward so that the distal end portions 164*b* of the gripping portions 164 are separated from the outer peripheral surfaces of the bearings 54, thereby allowing the pivot of the lock mechanism 160 about the second shaft 137. When the open button 18 is further depressed in this state, the lock mechanism 160 is pivoted about the second shaft 137 so that the gripping portions 164 retreat to the unlocking position where the bearings 54 are detachable from the roller insertion grooves 135. When the paper cover 20 is pulled up in this state, the bearings 54 of the platen roller 51 are detached from the roller insertion grooves 135. Thus, the platen roller 51 is removed from the main body frame 131, and the paper cover 20 is located at the opened position. Through the procedure described above, the operation of opening the paper cover 20 is finished.

By the way, when an external force is applied to the thermal printer 101 (printing unit 130), the lock mechanism 160 located at the locking position is moved relative to the main body frame 131 upward, namely in a direction in which the rear end edges of the shaft holes 181 approach the second shaft 137. As a result, there is a risk in that the gripping portions 164 may be separated from the outer peripheral surfaces of the bearings 54. Also in this case, due to the restoring forces of the biasing members 170, the lock mechanism 160 is moved relative to the main body frame 131 downward, namely in a direction in which the front end edges of the shaft holes 181 approach the second shaft 137. As a result, the lock mechanism 160 is promptly restored to the locking position. Thus, the abutment state in which the front end edges of the shaft holes 181 are brought into abutment against the second shaft 137 from the front side is maintained at the locking position. In particular, in the second embodiment, the longitudinal direction of each shaft hole 181 matches with the biasing direction of the biasing member 170, and hence the biasing force F of the biasing member 170 can effectively be applied in the longitudinal direction of the shaft hole 181. Thus, the second shaft 137 can be held at a predetermined position in the shaft hole 181 by a stronger force. Accordingly, it is possible to suppress rattling of the lock mechanism 160 more securely, thereby being capable of further stabilizing the position of the platen roller 51.

As described above, in the second embodiment, the second shaft 137 inserted through the shaft holes 181 formed in the lock mechanism 160 and configured to pivot the lock mechanism 160 relative to the main body frame 131 about the second shaft 137 is arranged on the main body frame 131. In addition, the biasing members 170 configured to bias the lock mechanism 160 toward the locking position and bring the second shaft 137 and the opening edges of the shaft holes 181 into abutment against each other are provided. According to this structure, the biasing members 170 bias the lock mechanism 160 toward the locking position and bring the second shaft 137 into abutment against predetermined positions on the opening edges of the shaft holes 181, thereby being capable of positioning the lock mechanism 160 at a desired position with respect to the main body frame 131. Thus, even if an external force is applied to the printing unit 130, for example, the movement of the second shaft 137 within the range of the shaft holes 181 can be suppressed. Accordingly, the holding force to be applied from the lock mechanism 160 to the platen roller 51 and the direction of application of the holding force can be stabilized so that the position of the platen roller 51 with respect to the thermal head 41 is stabilized, thereby being capable of securing the print quality.

Further, in the second embodiment, the second shaft 137 is brought into abutment against the predetermined positions on the opening edges of the shaft holes 181, and hence the accuracy of holding the platen roller 51 by the lock mechanism 160 is determined by the accuracy of the contact surface between the second shaft 137 and each of the predetermined positions on the opening edges of the shaft holes 181. Therefore, as compared to the case of the related-art printing unit where the circularity of the shaft hole, the coaxiality of the shaft hole and the pivot shaft, and the like are managed during the manufacture to guarantee the accuracy of holding the platen roller by the lock mechanism, the unevenness of manufacture can be suppressed easily, and a mold to be used for manufacturing the lock mechanism 160 having the shaft holes 181 can be managed easily, thereby being capable of reducing the manufacturing cost. Further, the shaft holes 181 are formed as the elongate holes, and hence the dimensions of the shaft holes 181 can be managed easily, thereby being capable of suppressing the unevenness of manufacture. In addition, the life of the mold for forming the shaft holes 181 is prolonged, thereby being capable of reducing the manufacturing cost.

Further, in the second embodiment, the shaft holes 181 are elongate holes, and the biasing members 170 are configured to bring the second shaft 137 into abutment against a part of each of the opening edges of the shaft holes 181, which is located on one end side in the longitudinal direction of each of the shaft holes 181. According to this structure, the second shaft 137 is brought into abutment against the part of each of the opening edges of the shaft holes 181, which is located on one end side in the longitudinal direction of each of the shaft holes 181, thereby being capable of holding the second shaft 137 at a desired position in each of the shaft holes 181 while restricting the movement of the second shaft 137 in the transverse direction of each of the shaft holes 181. Therefore, the position of the second shaft 137 in each of the shaft holes 181 is stabilized, thereby suppressing the rattling of the lock mechanism 160. Thus, the position of the platen roller 51 with respect to the thermal head 41 can further be stabilized.

Besides, the shaft holes 181 are formed as the elongate holes, and hence, as compared to a case where the shaft holes 181 are formed as, for example, perfect circles, the biasing direction of each of the biasing members 170 can be stabilized. As a result, the position of the platen roller 51 with respect to the thermal head 41 can further be stabilized, and the unevenness between the products can be suppressed.

Further, the biasing members 170 are interposed between the main body frame 131 (first shaft 136) and the lock mechanism 160 (third shaft 168). According to this structure, the biasing members 170 are mounted inside the printing unit 130, and hence the printing unit 130 can be assembled into the casing 3 under a state in which the biasing members 170 are mounted. Thus, as compared to the structure in which the biasing members 170 are interposed between the casing 3 and the lock mechanism 160, the printing unit 130 can easily be assembled into the casing 3, thereby being capable of reducing the manufacturing cost.

Further, the thermal printer 101 according to the second embodiment includes the printing unit 130, thereby being capable of stabilizing the position of the platen roller 51 with respect to the thermal head 41 to secure the print quality.

The present invention is not limited to the second embodiment described above with reference to the drawings, and various modified examples may be employed within the technical scope of the present invention. For example, in the second embodiment described above, the lock mechanism 160 is freely pivotable by the shaft hole 181 formed in the lock mechanism 160 and the second shaft 137 (pivot shaft) provided to the main body frame 131. However, the present invention is not limited thereto. The lock mechanism may be freely pivotable by a pivot shaft provided to the lock mechanism and a shaft hole formed in the main body frame.

Further, in the second embodiment described above, the longitudinal direction of the shaft hole 181 and the biasing direction of the biasing member 170 match with each other, namely are parallel to each other. However, it is only necessary that the intersection angle between the longitudinal direction of the shaft hole 181 and the biasing direction of the biasing member 170 be 45° or less. In this case, a force component corresponding to a half or more of the biasing forces of the biasing members 170 can be applied in the longitudinal direction of each of the shaft holes 180. Thus, the second shaft 137 can be held at a predetermined position in each of the shaft holes 181 by a stronger force. Accordingly, it is possible to suppress the rattling of the lock mechanism 160 more securely, thereby being capable of further stabilizing the position of the platen roller 51.

Figure 20:
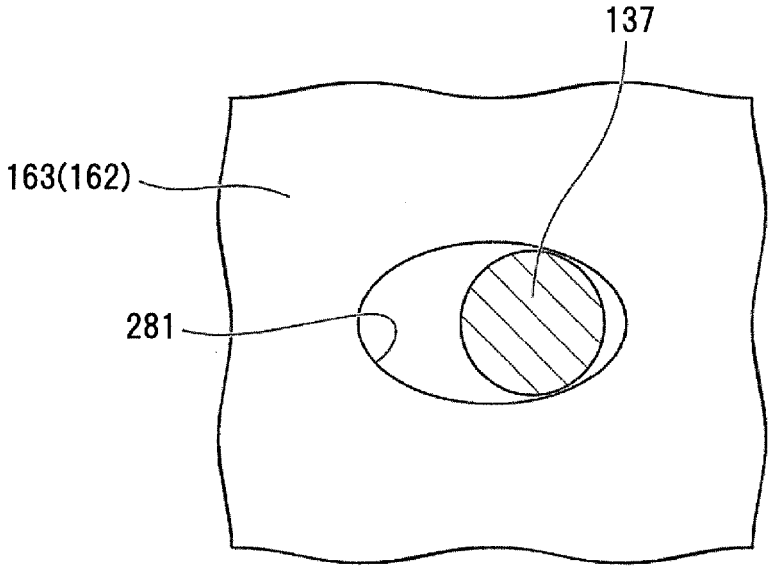
FIG. 20 is a side view of another structure of a shaft hole according to the second embodiment of the present invention.
Figure 21:
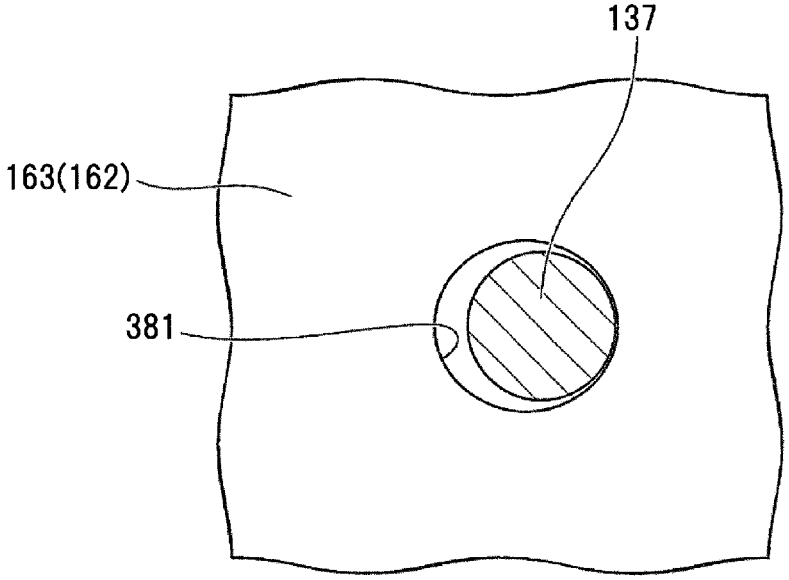
FIG. 21 is a side view of another structure of the shaft hole according to the second embodiment of the present invention.

Further, in the second embodiment described above, the shaft hole 181 is formed into an oblong shape, but the present invention is not limited thereto. For example, as illustrated in FIG. 20, a shaft hole 281 having an elliptical shape may be employed. In this case, it is desired that the curvature radii of both end portions of the shaft hole 281 in its longitudinal direction be set smaller than the radius of the second shaft 137. The second shaft 137 is brought into abutment against a part of the shaft hole 281, which is located on one end side in the longitudinal direction, and thus the second shaft 137 and the opening edge of the shaft hole 281 are brought into contact with each other at two positions, thereby being capable of further suppressing the rattling between the second shaft 137 and the shaft hole 281. Alternatively, as illustrated in FIG. 21, a shaft hole 381 having a circular shape may be employed. Also in this case, the second shaft 137 can be positioned at a desired position in the shaft hole 381 by the biasing member 170, thereby being capable of suppressing the movement of the second shaft 137 within a range of a fit tolerance between the second shaft 137 and the shaft hole 381. The shapes of the shaft hole and the pivot shaft (second shaft) are not limited to the above-mentioned shapes as long as the shaft hole and the pivot shaft are brought into abutment against each other at a predetermined position.

Besides the above, the components in the above-mentioned embodiments may be replaced by well-known components as appropriate without departing from the gist of the present invention.

What is claimed is:

1. A printing unit, comprising:

a main body frame;

a thermal head mounted on the main body frame;

a platen roller arranged so as to be opposed to the thermal head, which is configured to convey a recording sheet by rotating about an axis extending along a first direction under a state in which the recording sheet is nipped between the platen roller and the thermal head;

roller insertion grooves formed in the main body frame, into which the platen roller is inserted in a state of being removable from the roller insertion grooves along a second direction orthogonal to the first direction;

a lock arm supported so as to be pivotable about a pivot shaft extending along the first direction, which is configured to hold the platen roller inserted into the roller insertion grooves;

a moving mechanism configured to move the pivot shaft and including:

elongate holes formed in the lock arm; and a shaft portion fixed to the main body frame and fitted to the elongate holes;

biasing members configured to bias the lock arm; and gripping portions provided to the lock arm, which are configured to extend from a region opposite to the thermal head across the platen roller toward the thermal head under a holding state in which the gripping portions hold the platen roller, in which a distal end portion of each of the gripping portions is formed so as to be located close to the thermal head side with respect to an imaginary plane including a center axis of the platen roller and an axis of the pivot shaft under the holding state, in which the moving mechanism is configured to move the pivot shaft between a locking position where a pivot of the lock arm is restricted under the holding state and a pivoting position where the lock arm is freely pivotable between the holding state and a releasing state in which the platen roller is removable from the roller insertion grooves, and in which the biasing members are configured to:

bias the lock arm in a direction in which the pivot shaft is moved from the pivoting position to the locking position under the holding state; and bias the lock arm in a direction in which the lock arm is shifted from the releasing state to the holding state under a state in which the pivot shaft is located at the pivoting position.

2. A printing unit according to claim 1, wherein a part of the each of the gripping portions to be brought into contact with the platen roller is formed into an arc shape conforming to an outer peripheral surface of the platen roller when viewed in the first direction.

3. A printing unit according to claim 1, wherein a part of the each of the gripping portions to be brought into contact with the platen roller is formed into an arc shape conforming to an outer peripheral surface of the platen roller when viewed in the first direction.

4. A printing unit, comprising:

a main body frame;

a platen roller removably mounted on the main body frame;

a lock mechanism supported on the main body frame so as to be pivotable between a locking position where the platen roller is held on the main body frame in a rotatable manner and an unlocking position where the platen roller is detachable from the main body frame;

a thermal head held in press contact with an outer peripheral surface of the platen roller;

a pivot shaft provided to one of the main body frame and the lock mechanism and inserted through shaft holes formed in another of the main body frame and the lock mechanism, the pivot shaft being configured to pivot the lock mechanism relative to the main body frame about the pivot shaft, wherein the shaft holes are elongate holes; and biasing members configured to bias the lock mechanism toward the locking position and bring the pivot shaft and opening edges of the shaft holes into abutment against each other, wherein the biasing members are configured to bring the pivot shaft into abutment against a part of each of the opening edges of the shaft holes, which is located on one end side in a longitudinal direction of each of the shaft holes.

5. A printing unit according to claim 4, wherein an intersection angle between the longitudinal direction of the each of the shaft holes and a biasing direction of each of the biasing members is 45° or less.

6. A printing unit according to claim 4, wherein the biasing members are interposed between the main body frame and the lock mechanism.

7. A printing unit according to claim 4, wherein the biasing members are interposed between the main body frame and the lock mechanism.

8. A printing unit according to claim 5, wherein the biasing members are interposed between the main body frame and the lock mechanism.

9. A thermal printer, including:

the printing unit according to any one of claims 1, 2 through 4, and 5 through 8.

* * * * *